US008505229B2

(12) United States Patent
Savoy et al.

(10) Patent No.: US 8,505,229 B2
(45) Date of Patent: Aug. 13, 2013

(54) RAIL EXTENSION DEVICE

(76) Inventors: Dale J. Savoy, Weare, NH (US); Aidan N. Zimmerman, Medford, MA (US); Alan E. Tobey, Billerica, MA (US)

( * ) Notice: Subject to any disclaimer, the term of this patent is extended or adjusted under 35 U.S.C. 154(b) by 0 days.

(21) Appl. No.: 13/352,806

(22) Filed: Jan. 18, 2012

(65) Prior Publication Data

US 2012/0180365 A1 Jul. 19, 2012

Related U.S. Application Data

(60) Provisional application No. 61/434,222, filed on Jan. 19, 2011.

(51) Int. Cl.
*F41G 1/393* (2006.01)

(52) U.S. Cl.
USPC ..... 42/90; 42/128; 42/148

(58) Field of Classification Search
USPC ..... 42/72, 96, 90, 106, 75.02, 75.03, 42/75.04, 85, 87, 94, 124–128, 138, 148; 89/137, 153, 164, 171, 172, 176, 181, 190, 89/22, 23, 25, 33.14, 33.2, 37.03, 37.13, 89/41.17
See application file for complete search history.

(56) References Cited

U.S. PATENT DOCUMENTS

| | | | | |
|---|---|---|---|---|
| 2,644,237 | A * | 7/1953 | Pachmayr | 42/128 |
| 3,226,868 | A * | 1/1966 | Mahoney | 42/128 |
| 7,908,782 | B1 * | 3/2011 | LaRue | 42/128 |
| 8,393,104 | B1 * | 3/2013 | Moody et al. | 42/72 |
| 2006/0162227 | A1 * | 7/2006 | Samson | 42/148 |
| 2011/0296732 | A1 * | 12/2011 | Carlson et al. | 42/90 |

* cited by examiner

*Primary Examiner* — Michael Carone
*Assistant Examiner* — John D Cooper
(74) *Attorney, Agent, or Firm* — L-3 Communications WSD

(57) ABSTRACT

A rail extension device for a belt fed machine gun includes a first and a second section of rail for mounting auxiliary devices, the second section being rotatable relative to the first section to prevent a collision between an auxiliary device mounted on the second section of rail and the weapon when a feed tray cover is opened to reload.

3 Claims, 20 Drawing Sheets

RAIL EXTENSION DEVICE

CROSS REFERENCE TO RELATED APPLICATIONS

This application claims the benefit of U.S. provisional patent application Ser. No. 61/434,222 filed Jan. 19, 2011, the entire disclosure of which is incorporated herein by reference in its entirety.

TECHNICAL FIELD

The present disclosure relates to rail interface systems, and, more particularly, to a rail extension device for a firearm.

BACKGROUND

The need to effectively see a target and aim a weapon in the direction of the target is well-recognized. Auxiliary devices to facilitate illuminating a target or aiming a weapon are known. Examples of known auxiliary devices include scopes, visible and infrared illuminators, laser pointers, combined illuminator/laser pointer devices, night vision devices and/or infrared imagers. Auxiliary devices may be mounted onto a rail(s) of a firearm to provide increased flexibility or broader functionality. The rail(s) may be generally parallel with a weapon barrel and may be positioned above, below, or to the side of the barrel to provide one or more locations for the mounting of accessory devices. Auxiliary devices are often mounted to weapons having a rail with a certain profile, for example a rail profile consistent with the MIL-STD-1913.

Some auxiliary devices may be paired with another auxiliary device, wherein the combination provides an enhanced use. For example, a night vision scope may be paired with and used in conjunction with an optical scope. In another example, an optical scope may be paired with a secondary power multiplier or extender. When a user pairs auxiliary devices, they may have one device mounted at a rear portion of the firearm and the additional device mounted at a forward portion of the firearm. FIG. 1 is an isometric view of a firearm, shown as a machinegun. According to one embodiment, the firearm 100 may be an M240 machine gun having a mounting rail 120, e.g. a RIS system, having a MIL-STD-1913 Picatinny profile. In the illustrated embodiment, a daytime scope 118 may be mounted to a rear portion of the mounting rail 120. In certain conditions, the daytime scope 118 may be unusable due to weather conditions, such as lack of sunlight. If a user decides to exchange the daytime scope 118 with a night vision capable scope, for example, each scope may need to be individually adjusted when remounted to the firearm 100. Changing devices may be difficult and time consuming. Each time an auxiliary device is exchanged, the firearm 100 may require sight adjustment, which may become cumbersome and waste valuable time, especially in military or force protection situations. A user may wish to mount an additional scope, e.g. a night vision scope 222 (shown in FIG. 2) to an extended rail section of the mounting rail 120 in front of the daytime scope 118, i.e. a position closer to the barrel 102, in order to add nighttime operation and capability to the daytime scope 118 without the need to replace the daytime scope 118. It is to be understood that systems consistent with the present disclosure may be used in connection with a variety of auxiliary device configurations, and is not limited to the combination of night vision and daytime auxiliary devices.

The firearm 100 may include a barrel 102, a buttstock 104, a folding bipod stand 106 configured to support the firearm 100, a receiver assembly 108, a trigger housing assembly 110, a feed tray 112 and a feed tray cover 114 in a closed position. The barrel 102 defines the forward portion of the firearm 100 and the buttstock 104 defines the rearward portion of the firearm 100. The longitudinal axis A of the firearm 100 may extend generally parallel with the barrel 102. The receiver assembly 108 may serve as a support for all major components and may house the action of the firearm 100, and through a series of cam ways, may control functioning of the firearm 100. The feed tray 112 may serve as a guide for positioning a linked ammunition belt to assist in chambering of the ammunition. The feed tray cover 114 may serve as an upper portion of the feed tray 112 and may be configured to feed linked ammunition belts and hold ammunition cartridges in position for stripping, feeding, and/or chambering. The mounting rail 120 may be formed as an integral part of the feed tray cover 114 and may be generally parallel with the longitudinal axis A of the firearm 100 and the barrel 102. The firearm 100 may further include a carrying handle 116 attached to the barrel 102, wherein the carrying handle may be configured to assist in handling and/or changing the barrel 102.

FIG. 2 is a side view of a portion of the firearm of FIG. 1 with the feed tray cover 114 rotated to an open position. Mounted to the mounting rail 120 maybe the daytime scope 118. For purposes of illustration, an auxiliary device, for example a night vision scope 222 is positioned in front of the daytime scope 118. The feed tray cover 114 may be rotatably coupled to a portion of the receiver assembly 108 and may be configured to move between an open and closed position as indicated by the double arrow 226. When the firearm 100 is equipped with an additional auxiliary device, such as the night vision scope 222, the feed tray cover 114 may not be able to fully rotate to an open position due to the scope striking a portion of the weapon. In the illustrated embodiment, rotation of the feed tray cover 114 to the open position may be prevented due to the night vision scope 222 making physical impact (indicated by the arrow 228) with a portion of the receiver assembly 108. In this instance, the user may be required to remove the night vision scope 222 in order for the feed tray cover 114 to fully rotate to the open position, resulting in wasting valuable time during combat situations.

FIG. 3 is a front view of the firearm of FIG. 1 having the night vision scope 222 attached to the mounting rail 120 with the handle 116 and barrel 102 alternating between a first position and a second position during a barrel removal. In the illustrated embodiment, the quick-detachable barrel 102 may be configured to be removed rapidly via a barrel release button (not shown) and rotation of the carrying handle 116. When the carrying handle 116 is in a first position, shown in FIG. 1, the barrel 102 is securely fixed to the receiver assembly 108 of the firearm 100. The carrying handle 116 is configured to move from the first position, generally parallel a side surface of the receiver assembly 108 of the firearm 108, to a second position, generally parallel to a top surface of the receiver assembly 108. When the carrying handle 116 is in the second position, the barrel 102 may be removed from the firearm 102. In the illustrated embodiment, the carrying handle 116 may be configured to move from first and second positions as indicated by the double arrow 330 and barrel 102 may be configured to move from first and second positions as indicated by the double arrow 332.

When the firearm 100 is equipped with an additional auxiliary device, such as the night vision scope 222, the carrying handle 116 may not be able to fully rotate to the second position thus preventing removal of the barrel 102. Rotation of the carrying handle 116 to the second position may be prevented due to the night vision scope 222 making physical impact (indicated by the arrow 334) with a portion of the carrying handle 116. In this instance, the user would be required to remove the night vision scope 222 in order for the carrying handle 116 to fully rotate to the second position to remove the barrel 102.

In addition to the problems described above, users may have difficulty with the current method of opening the feed tray cover of a M240 machinegun. Opening of the feed tray cover may be particularly difficult when an auxiliary device and/or sight is coupled near the rear position of the firearm, which may require a user to use both hands. For example, in the illustrated embodiment of FIG. 2, feed tray cover 114 may include locking latches 224 located on either side of the feed tray cover 114. The locking latches 224 are configured to secure the feed tray cover 114 to the feed tray 112 when the feed tray cover 114 is in a closed position. When a user needs to open the feed tray cover 114, the user applies an inward force to both the locking latches 224 in order to release the feed tray cover 114 from the feed tray 112. A user may then lift the feed tray cover 114 into an open position. Due to the position of the locking latches 224 on either side of the feed tray cover 114, it may be difficult for a user to apply the necessary inward force to both latches 224 with one hand, particularly when a scope or other auxiliary device is coupled near the rear position of the firearm. Instead, a user may need to use both hands to apply proper force, which may be cumbersome and time-consuming.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

In general, a rail extension device consistent with the present disclosure may be configured to be coupled to a firearm. The rail extension device may include a base plate having a top surface defining a first rail interface, the base plate having a first end configured to be rotatably coupled to a frame portion of the firearm and a second end configured to be coupled to a feed tray cover of the firearm. The base plate may be movable about a first axis between a first base plate position and a second base plate position, wherein the first axis may be substantially orthogonal with a barrel of the firearm. The rail extension device may further include a rail member having a top surface defining a second rail interface, wherein the rail member may be rotatably coupled to the base plate and movable about a second axis between a first rail member position and a second rail member position. The second axis may be substantially parallel with the barrel of the firearm when the base plate is in the first base plate position. When the rail member and base plate are in the first rail member position and the first base plate positions, respectively, the top surface of the base plate and the top surface of the rail member may form a substantially planar rail interface. When the rail member is in the second rail member position, the top surface of the rail member may be substantially orthogonal to the top surface of the base plate. The rail extension device may further include a release assembly configured to apply pressure to locking latches of a feed tray cover of the firearm. The release assembly may be configured to allow the feed tray cover to be opened with one hand.

A device consistent with the present disclosure may allow a user to fully open the feed tray cover while having paired auxiliary devices mounted on the firearm, eliminating the need to remove either of the devices, allowing the devices to remain aligned and calibrated. Further, a device consistent with the present disclosure may allow a quick and easy one-handed method of opening the feed tray cover, particularly when an auxiliary device and/or a sight is coupled near the rear position of the firearm.

Figure 4A:
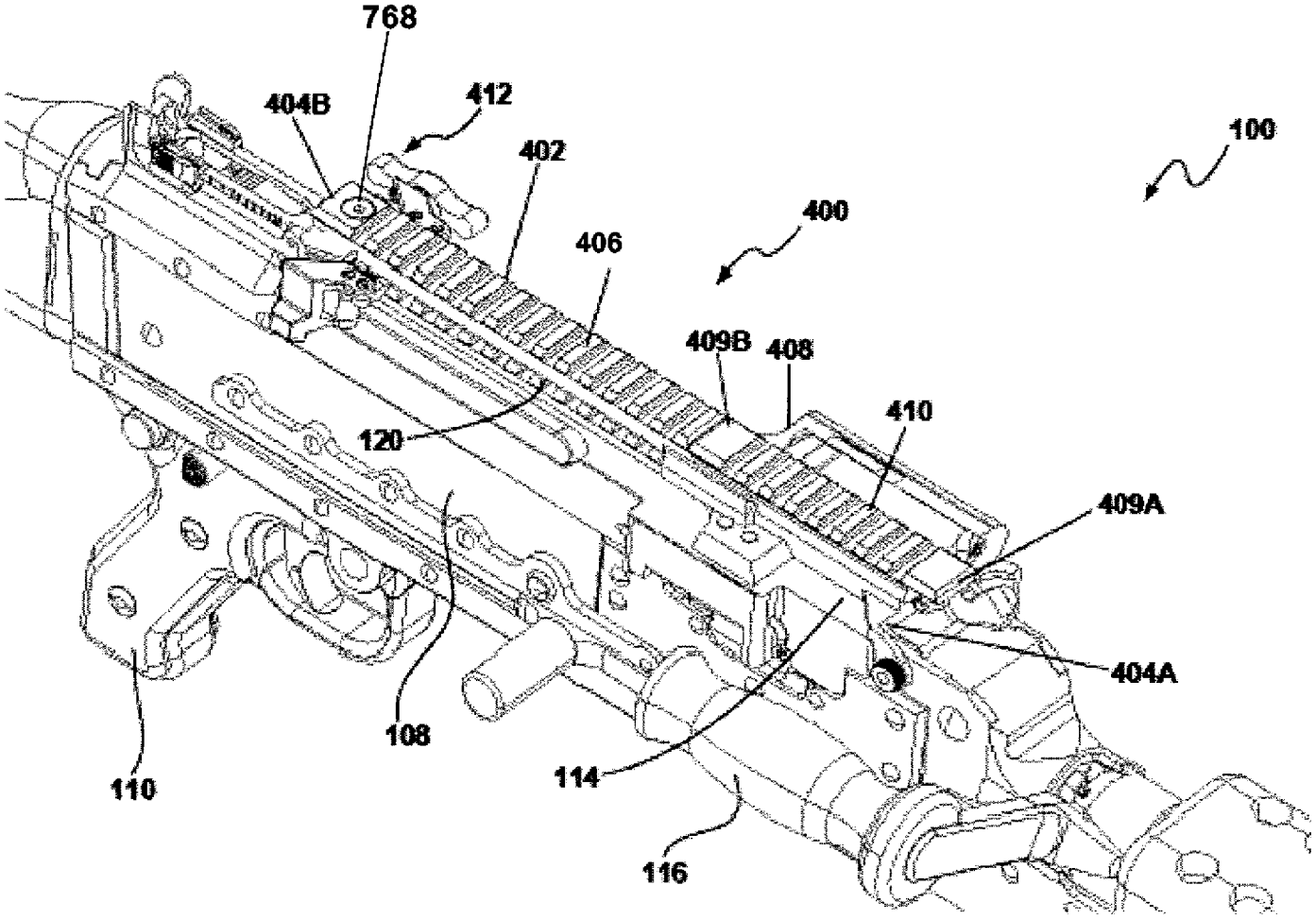
FIG. 4A is an isometric view of one embodiment of a rail extension device mounted on the standard rail interface system of the firearm of FIG. 1 with the feed tray cover in the closed position, consistent with the present disclosure.
Figure 4B:
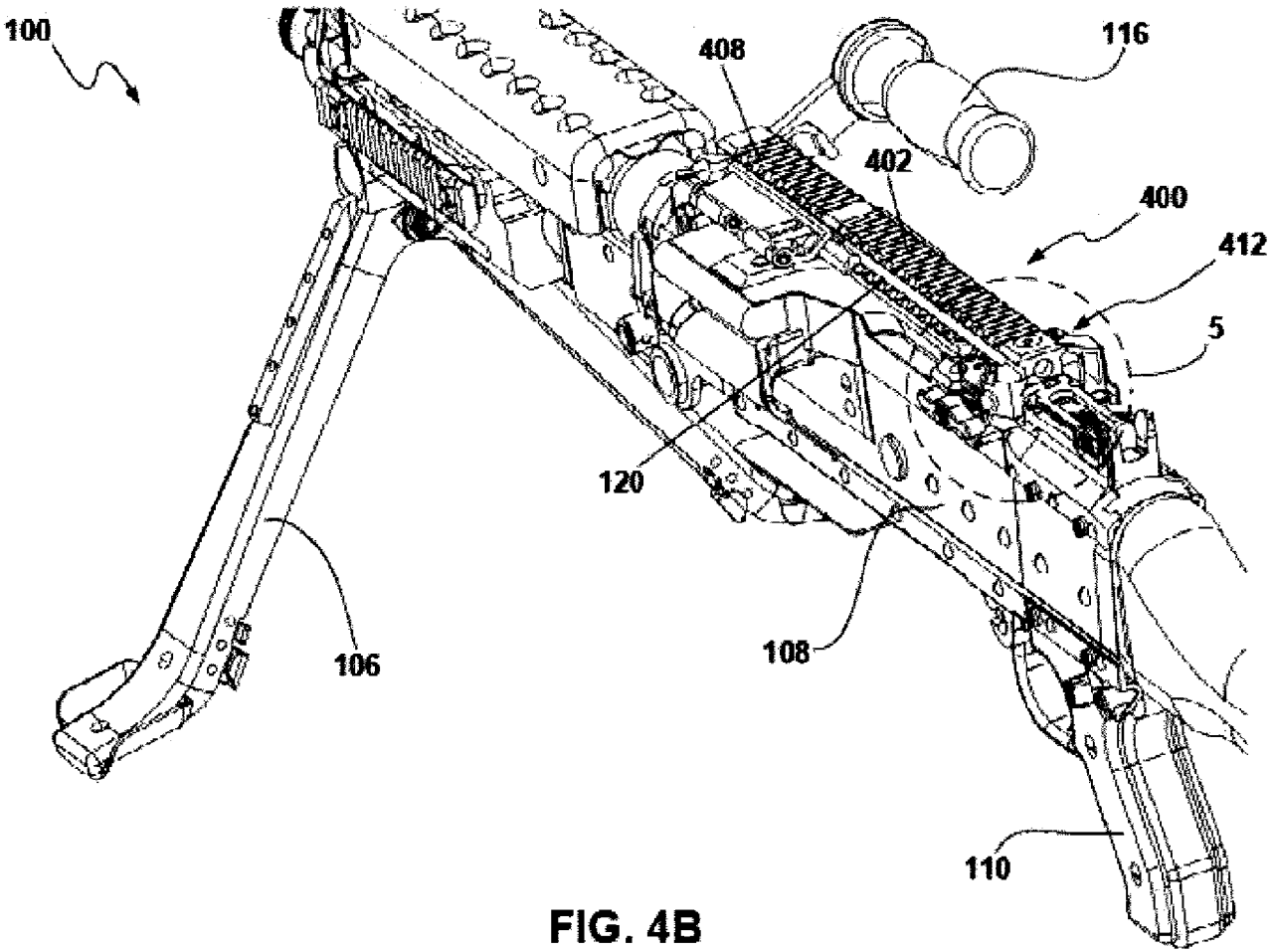
FIG. 4B is an alternate isometric view showing a feed tray cover release assembly of the rail extension device of FIG. 4A.

The rail extension device 400 of the present disclosure is intended for use with any known type of weapon and/or firearm. For purpose of illustration throughout the entirety of the present disclosure, a typical military combat firearm 100, e.g. an M240 machine gun, is depicted. FIGS. 4A-4B are isometric views of one embodiment of a rail extension device mounted on the firearm of FIG. 1 with the feed tray cover 114 in the closed position, consistent with the present disclosure. In the illustrated embodiment, the rail extension device 400 is mounted to the typical mounting rail 120 of the firearm 100.

In the embodiments described herein, the rail extension device 400 includes a base plate 402 having a first base plate end 404A configured to be rotatably coupled to a portion of the receiver assembly 108. The base plate 402 has a second base plate end 404B configured to be coupled to the feed tray cover 114 via a fastener, such as a screw 768 (shown in FIG. 7C), sized and/or shaped to pass through an aperture 770 (shown in FIG. 7C) defined on the second base plate end 404B. In the illustrated embodiment, the first base plate end 404A is in a position near the front (barrel 102) of the firearm 100 and the second base plate end 404B is in a position closer to the rear (buttstock 104) of the firearm 100. The base plate 402 may further include a top surface 406, generally parallel to the axis A in a horizontal plane when in a first base plate position, wherein the top surface 406 may define an interface to which various auxiliary devices can be mounted. The rail extension device 400 further includes a rail member 408 rotatably coupled to the base plate 402, wherein the rail member 408 includes a first rail member end 409A and a second rail member end 409B. In the illustrated embodiment, the first rail member end 409A is positioned near the front of the firearm 100 and the second rail member end 409B is in a position closer to the rear of the firearm 100. Similar to the base plate 402, the rail member 408 includes a top surface 410, generally parallel to the axis A when in the first rail member position and the base plate 402 in the first base plate position, wherein the top surface 410 may define an interface to which auxiliary devices can be mounted. The rail extension device 400 may further include a feed tray cover release assembly 412 described in greater detail below. In the illustrated embodiment, the top surfaces 406, 410 of the base plate 402 and rail member 408, respectively, may have a MIL-STD-1913 Picatinny standard rail profile. For example, the top surfaces 406, 410 may define a series of ridges with a T-shaped cross-section interspersed with flat "spacing slots". Auxiliary devices can be mounted to the base plate 402 and rail member 408 by a variety of means known to one skilled in the art.

Figure 5:
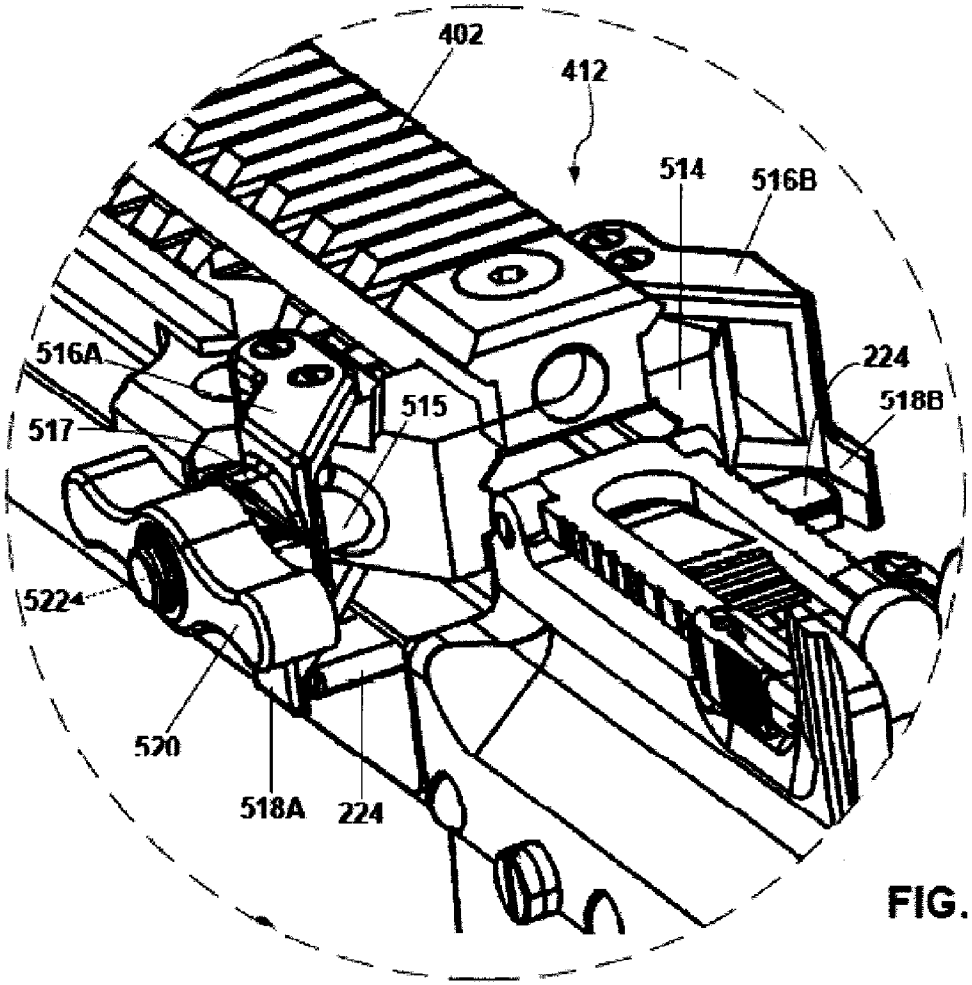
FIG. 5 is an enlarged view of a portion of the rail extension device of FIG. 4B.

FIG. 5 is an enlarged view of the feed tray cover release assembly 412 of the rail extension device 400 of FIGS. 4A-4B. In the illustrated embodiment, the feed tray cover release assembly 412 includes a rail mount body 514 configured to engage the mounting rail 120 defined on the firearm 100. The feed tray cover release assembly 412 may also include a first rigid member 516A coupled to a first portion of the rail mount body 514 and a second rigid member 516B coupled to a second portion of the rail mount body 514, wherein the first and second portions oppose one another. For example, in the illustrated embodiment, the first rigid member 516A may be coupled to a left side (based on a proximal or user view) of the rail mount body 514 and the second rigid member 516B may be coupled to a right side, such that the first and second rigid members 516A, 516B oppose one another. The first and second rigid members 516A, 516B may define first and second contact portions 518A, 518B, respectively, configured to make contact and engage locking latches 224 located on corresponding sides of the feed tray cover 114.

The feed tray cover release assembly 412 further includes a release lever 520 coupled to a shaft 515 extending from the rail mount body 514. The shaft 515 may provide an axis 522, generally perpendicular to axis A on the horizontal plane, about which the release lever 520 may rotate from a first release lever position (shown in the FIG. 5) to a second release lever position (rotation of approximately 90 degrees). The first rigid member 516A defines a cammed surface 517 configured to provide a prescribed motion to a roller member 786 (shown in FIG. 7C) coupled to the release lever 520. In the illustrated embodiment, the release lever 520 is coupled to the left side of the rail mount body 514 and configured to engage the cammed surface 517 of the first rigid member 516A via the roller member 786 (shown FIG. 7C). In another embodiment, the release lever 520 may be coupled to a shaft (not shown) extending from the right side of the rail mount body 514, wherein the release lever 520 may be configured to engage a cammed surface (not shown) of the second rigid member 516B.

The release lever 520 may be configured to apply a force to the cammed surface 517 of the first rigid member 516A via the roller member 786 (shown FIG. 7C) when the release lever 520 rotates to the second release lever position, such that the first and/or second contact portions 518A, 518B move in an inward direction towards the rail mount body 514 (a direction generally perpendicular to axis A on the horizontal plane), thereby forcing the respective locking latches 224 inward and allowing the feed tray cover 114 to be opened by the user. The first and second rigid members 516A, 516B may be horizontally spaced (e.g. generally perpendicular to the axis A on the horizontal plane) by a distance slightly greater than a width of the feed tray cover 114, including the locking latches 224, such that when the release lever 520 is in the first release lever position, the first and second contact portions 518A, 518B may make contact with, but do not force the respective locking latches 224 inward, thereby allowing the feed tray cover to remain in a closed position. The operation of the feed tray cover release assembly 412 will be described in greater detail below.

It should be noted that the feed tray cover release assembly 414 may be coupled to the existing mounting rail 120 of the firearm 100 and fully operable without the addition of the rail extension device 400 to the firearm 100.

Figure 6:
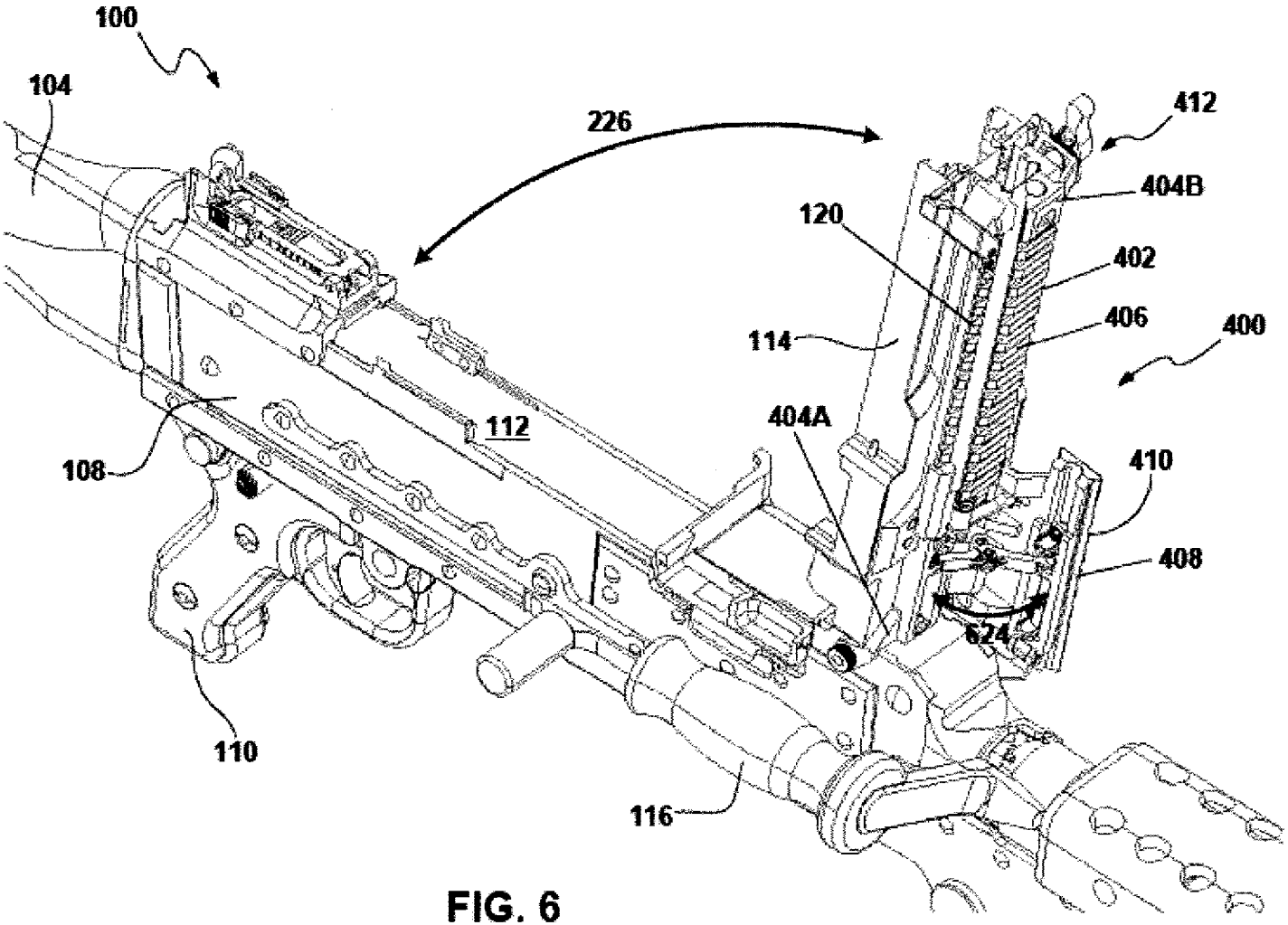
FIG. 6 is an isometric view of the rail extension device of FIG. 4A with the feed tray cover in the opened position.

FIG. 6 is an isometric view of the rail extension device of FIG. 4A with the feed tray cover in the opened position. As described above, upon application of appropriate amount of force against the locking latches 224, the user may open the feed tray cover 114. In the illustrated embodiment, the rail extension device 400 may be coupled to the feed tray cover 114, such that, the base plate 402 of the rail extension device 400 may move about an axis 732 (shown in FIGS. 7A-7B) between a first base plate position and a second base plate position in conjunction with the rotation of feed tray cover 114 between the closed and open positions as indicated by the double arrow 226. The first base plate position may correspond to the closed position of the feed tray cover 114 and the second base plate position may correspond to the open position of the feed tray cover 114. In other words, when the feed tray cover 114 is in the closed position (shown in FIG. 4A) the base plate 402 is in the first base plate position and when the feed tray cover 114 is in the open position (shown in FIG. 6) the base plate 402 is in the second base plate position.

Figure 7A:
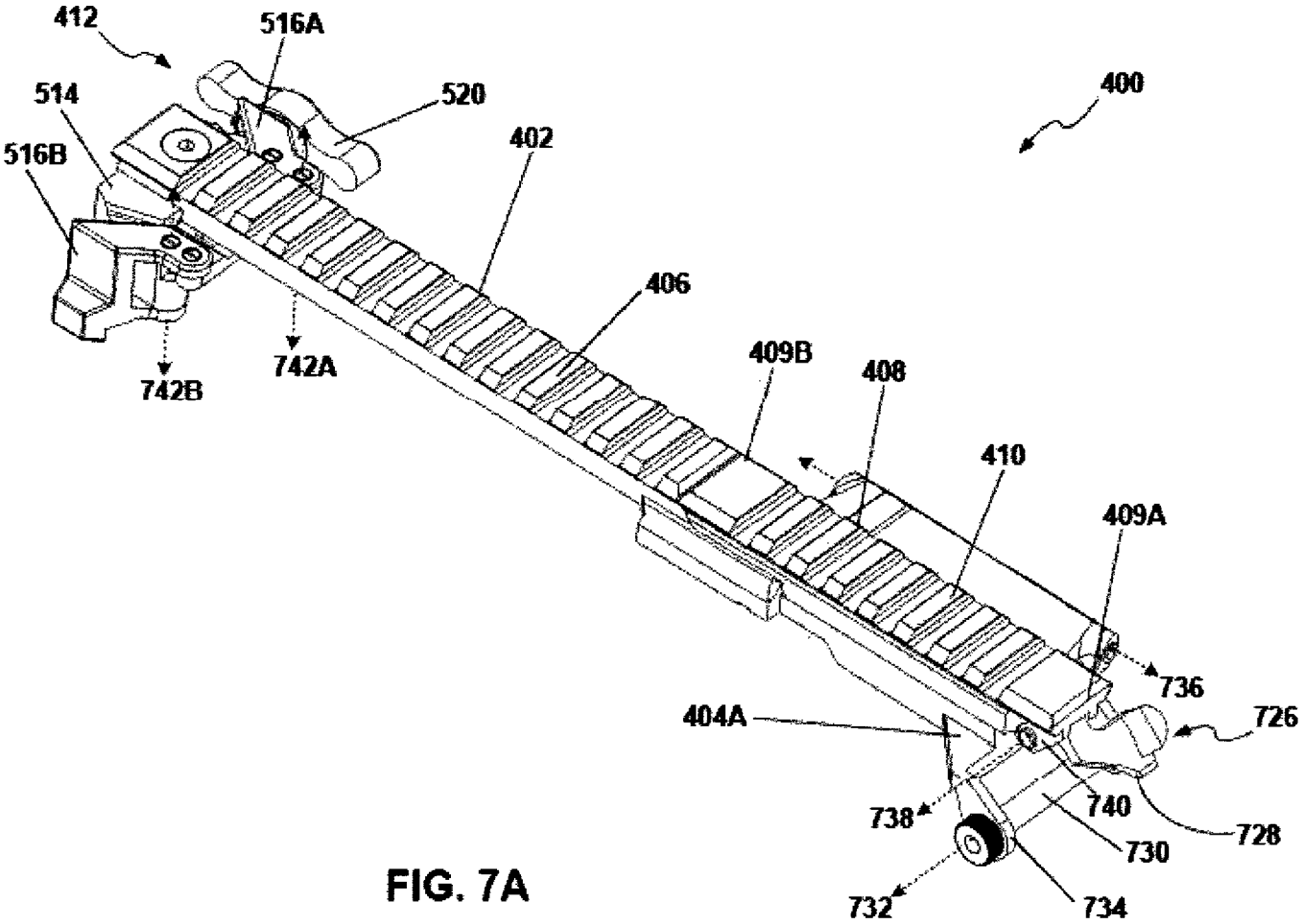
FIG. 7A is an isometric view of the rail extension device of FIG. 4A with the rail member in a first rail member position.
Figure 7B:
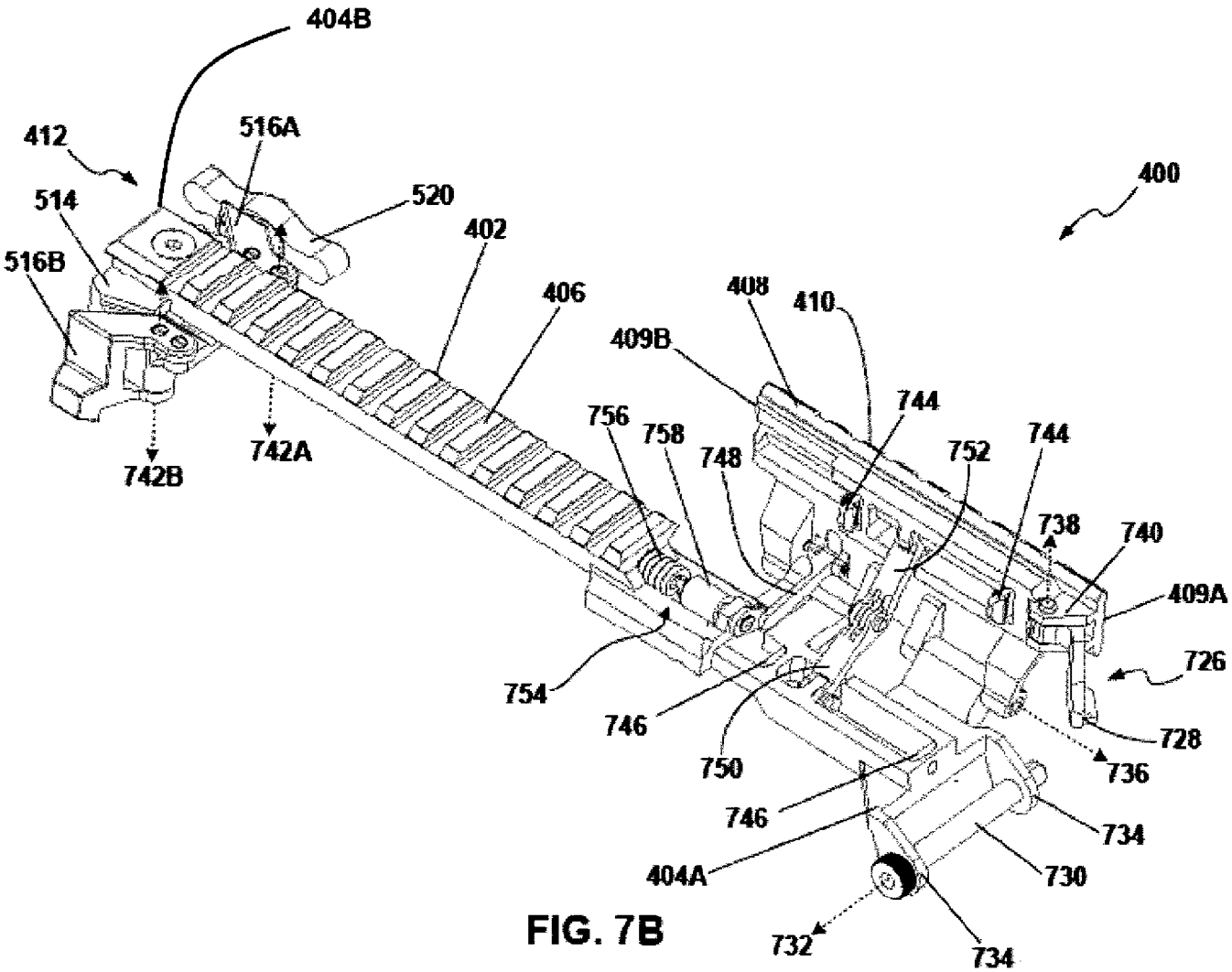
FIG. 7B is an isometric view of the rail extension device of FIG. 4A with the rail member in a second rail member position.

The rail member 408 of the rail extension device 400 may be configured to move about an axis 736 (shown in FIGS. 7A-7B) between a first rail member position (shown in FIG. 7A) and a second rail member position (as shown in FIGS. 6 and 7B) as indicated by the double arrow 624. When in the second rail member position, the top surface 410 of the rail member 408 may be substantially perpendicular to the top surface 406 of the base plate 402. When in the first rail position (shown in FIG. 7A), the top surface 410 of the rail member 408 and the top surface 406 of the base plate 402 may form a substantially planar interface.

Figure 2:
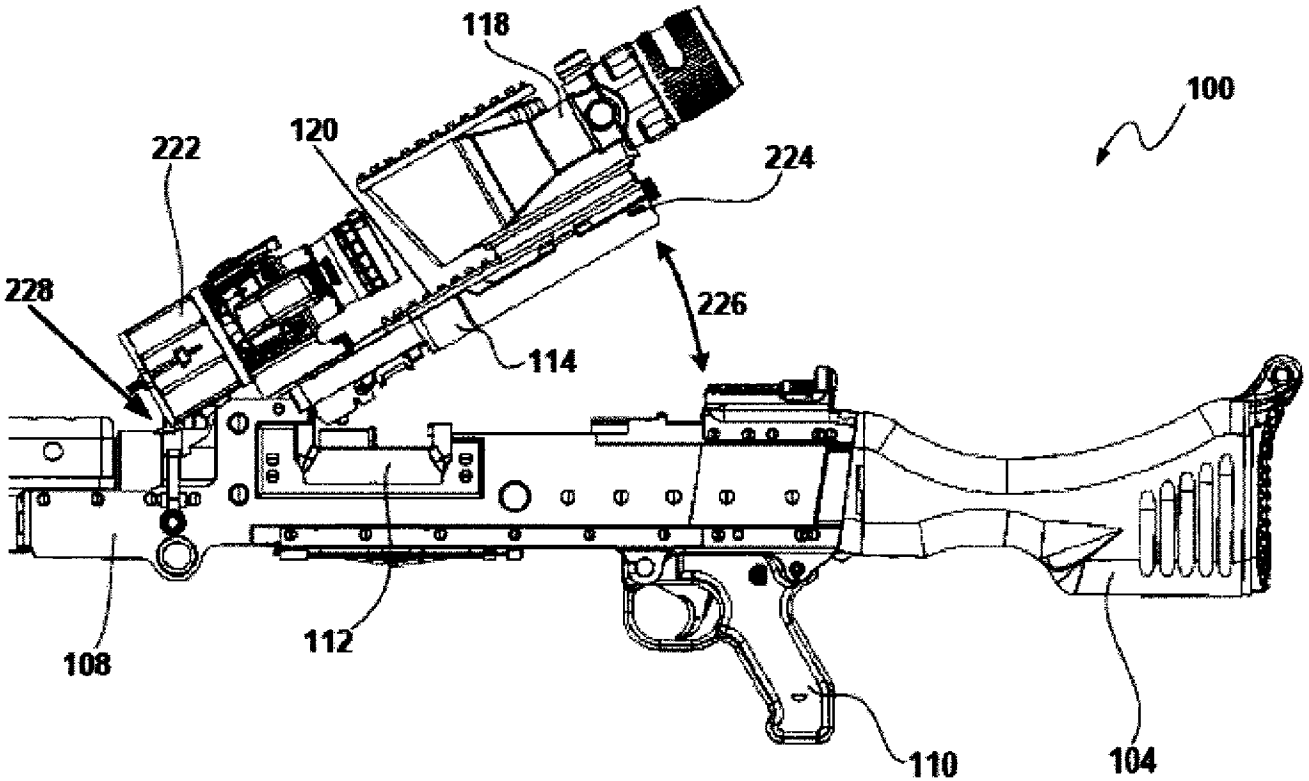
FIG. 2 is a side view of a portion of the firearm and the rail interface system and scope of FIG. 1 having a front scope attached thereto with the feed tray cover in an opened position.
Figure 3:
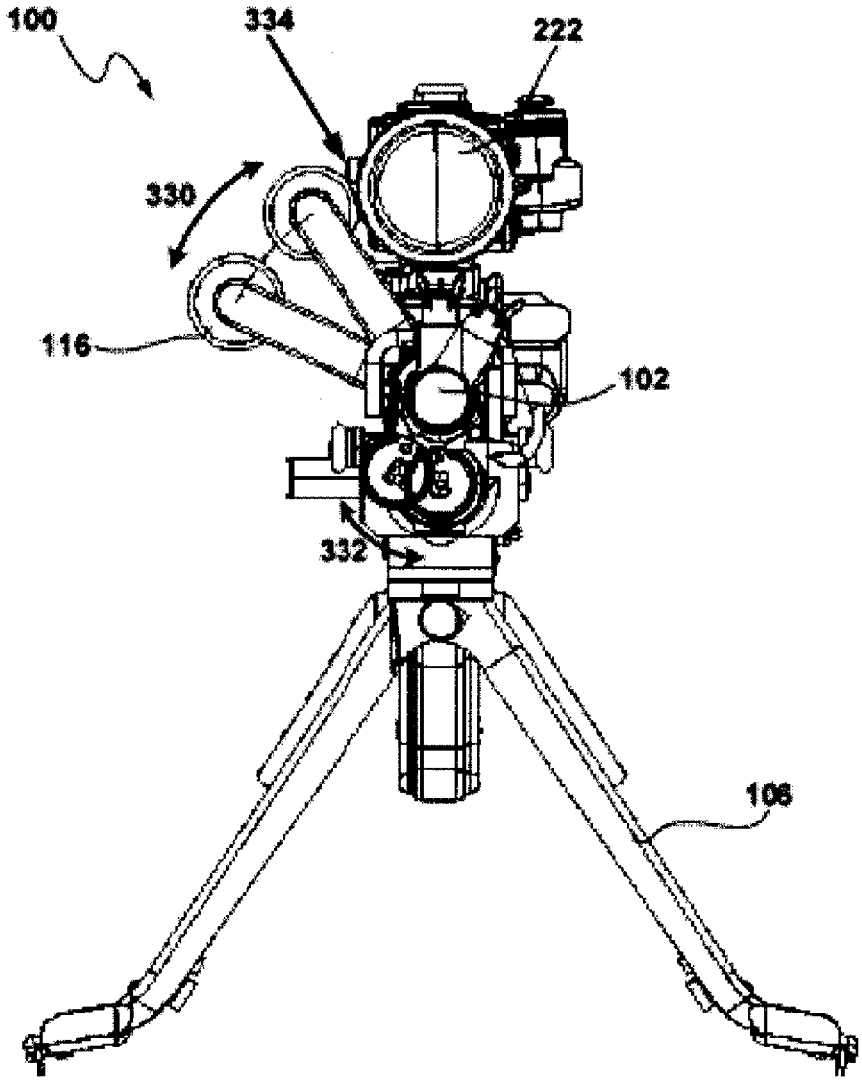
FIG. 3 is a front (distal or muzzle facing) view of the firearm of FIG. 1 having a standard rail interface system and front and rear scopes attached thereto with a handle and barrel of the firearm alternating between a first position and a second position during a barrel exchange.

FIG. 7A is an isometric view of the rail extension device of FIG. 4A with the rail member in the first rail member position. As described above, the first and second contact portions 518A, 518B of the first and second rigid members 516A, 516B, respectively, may be configured to move in an inward direction towards the rail mount body 514 thereby forcing respective locking latches 224 (shown in FIGS. 2, 4B, and 5) in an inward direction. In the illustrated embodiment, the first contact portion 518A (shown in FIG. 5) may be moved about a vertical axis 742A and the second contact portion 518B may move about a vertical axis 742B, wherein the axes 742A, 742B are generally perpendicular to axis A on a vertical plane when the base plate 402 is in the first base plate position.

The first base plate end 404A includes at least one support member 734 extending therefrom. The at least one support member 734 defines an aperture through which a wrist pin 730 may pass and extend therefrom generally perpendicular to axis A on the horizontal plane. The wrist pin 730 may provide the axis 732 on which the base plate 402, as well as feed tray cover 114, rotates. The wrist pin 730 may be configured to retain at least the first base plate end 404A to the receiver assembly 108 of the firearm 100. The wrist pin 730 may further include a latch member 794 (shown in FIG. 7C) configured to secure the wrist pin 730 to the support member 734. In the illustrated embodiment, the first base plate end 404A includes first and second support members 734 extending therefrom (shown in FIGS. 7B-7C), wherein the wrist pin 730 extends between and is supported by at least both the first and second mounting members 734.

The first rail member end 409A includes at least one support member 740 extending therefrom. The at least one support member 740 defines an aperture through which a fastener, such as a pin 804 (shown in FIG. 7C) may pass and extend therefrom generally perpendicular to axis A on the horizontal plane when the rail member 408 is in the first rail member position. In the illustrated embodiment, the first rail member end 409A includes first and second support members 740 extending therefrom (shown in FIG. 7C), wherein the pin 804 (shown in FIG. 7C) extends between and is supported by at least both the first and second mounting members 740. A fastener, such as an e-clip 806 (shown in FIG. 7C) may be configured to secure and retain the pin 804 to the support members 740.

The rail extension device 400 further includes a release trigger 726 rotatably coupled to the first and second support members 740 of the rail member 408 via the pin 804. The release trigger 726 may be configured to move about an axis 738, generally perpendicular to axis A on the horizontal plane, between a first release trigger position and a second release trigger position. The pin 804 may provide the axis 738 on which the release trigger 726 rotates. The release trigger 726 may define a contact portion 728 configured to make contact with at least a portion of the receiver assembly 108 when the feed tray cover 114 and base plate 402 are rotated in directions toward the open position. When the release trigger 726 is moved to the second release trigger position, the rail member 408 moves about the axis 736, generally parallel with axis A, from the first rail member position to the second rail member position, the process of which is described in greater detail below.

FIG. 7B is an isometric view of the rail extension device of FIG. 4A with the rail member in the second rail member position. In the illustrated embodiment, the release trigger 726 may be coupled to at least one hook 744. The at least one hook 744 is configured to matingly engage at least one catch 746 coupled to the base plate 402 when the rail member 408 is in the first rail member position. The at least one catch 746 is configured to retain the rail member 408 in the first rail member position. In the illustrated embodiment, the release trigger 726 is coupled to first and second hooks 744 via a shaft 808 (shown in FIG. 7C), wherein the shaft 808 may be positioned within a channel 810 (shown in FIG. 7C) configured to receive the shaft 810 and first and second hooks 744. The first and second hooks 744 may each define apertures through which the shaft 810 may pass. The first and second hooks 744 may be extending from a bottom surface of the rail member 408, wherein the bottom surface may be sized and shaped to correspond to and cooperate with a portion of the base plate 402 when the rail member 408 is in the first rail member position.

The release trigger 726 may be configured to apply a force to the first and second hooks 744 when in the second release trigger position, such that the first and second hooks 744 disengage from the first and second catches 746. When the release trigger 726 is in the second release trigger position, the first and second hooks 744 disengage from the first and second catches 746, thereby allowing the rail member 408 to rotate about axis 736 from the first rail member position to the second rail member position. In the illustrated embodiment, when the first and second hooks 744 disengage from the first and second catches 746, the rail member 408 is configured to rotate in a direction towards the left side (from a proximal or user facing view) of the rail extension device 400, generally in a direction away from the carrying handle 116. It should be noted that in another embodiment, rotation of the rail member 408 from the first rail member position to the second rail member position may be reversed, wherein the rail member 408 may rotate to the right side (from a proximal or user facing view) of the rail extension device 400 (assuming the carrying handle 116 position is also reversed, such that the carrying handle is on the left side of the firearm 100).

The rail extension device 400 further includes a bracket 748 having a first end coupled to a lever member 764 (shown in FIG. 7C) of a spring assembly 754 and a second end coupled to the rail member 408. The spring assembly 754 includes a torsion spring 756 coupled to an arbor member 758. The spring assembly 754 described in greater detail below. The rail extension device 400 further includes a first link 750 and a second link 752, wherein the first and second links 750, 752 have first and second ends. The first end of the first link 750 is coupled to the base plate 402 and the first end of the second link 752 is coupled to the rail member 408. The second end of the first link 750 is coupled to the second end of the second link 752. The first and second links 750, 752 are configured to retain the rail member 408 when in a second rail member position, thereby preventing the rail member 408 from over-rotating past the second rail member position.

Figure 7C:
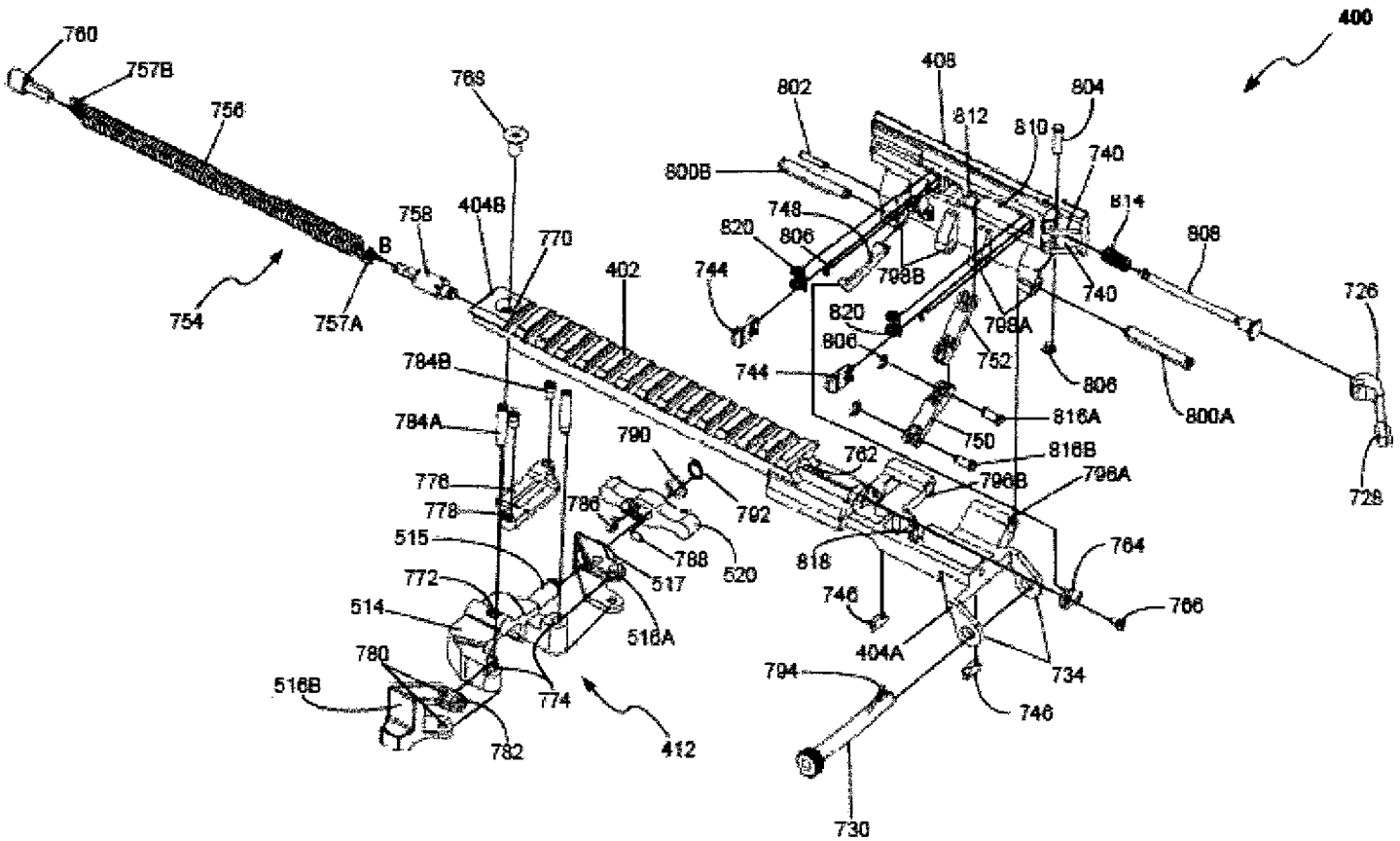
FIG. 7C is an exploded view of the rail extension device of FIG. 4A with the rail member in the second rail member position.

FIG. 7C is an exploded view of the rail extension device of FIG. 4A with the rail member in the second rail member position. In the illustrated embodiment, the first end of the bracket 748 is rotatably coupled to the rail member 408 via a fastener, such as a spring pin 802, configured to retain the first end of the bracket 748 and provide an axis, generally parallel with axis A, about which the bracket 748 may rotate. The second end of the bracket 748 is coupled to the lever member 764 of the spring assembly 754 via a protrusion formed on the second end of the bracket 748. The protrusion is sized and/or shaped to matingly engage a first aperture defined on a portion of the lever member 764, wherein the protrusion forms an axis, generally parallel with axis A, about which the bracket 748 may rotate. The lever member 764 further defines a second aperture through which a fastener 766 passes and fixes the lever member 764 to the arbor member 758.

In the illustrated embodiment, the torsion spring 756 has a first torsion spring end 757A and a second torsion spring end 757B. The first torsion spring end 757A is coupled to the arbor member 758 and the second torsion spring end 757B is coupled to a torsion adjuster member 760. The base plate 402 includes a channel 762 generally extending along a longitudinal length of the base plate 402 in a direction generally parallel to axis A. The channel 762 is configured to house at least a portion of the torsion spring 756. The arbor member 758 and torsion adjuster member 760 may be configured to retain the torsion spring 756 within the channel 762. The torsion spring 756 may include a flexible metal wire or a high-strength elastic material and have a general helical shape, wherein the torsion spring 756 may provide an axis B, generally parallel to axis A, about which first and second torsion spring ends 757A, 757B may rotate. The torsion spring 756 may be configured to store a mechanical energy when the first and second torsion spring ends 757A, 757B are rotated about axis B in opposite directions. Those skilled in the art will recognize that the torsion spring 756 may be configured to store a mechanical energy when the first torsion spring end 757A is rotated about axis B and the second torsion spring end 757B is fixed and/or vice versa (first torsion spring end 757A fixed and second torsion spring 757B is rotated). It should be noted that in other embodiments, a torsion bar may be included as opposed to a spring.

In the illustrated embodiment, the torsion adjuster member 760 may be configured to secure the second torsion spring end 757B in a fixed position and to increase and/or decrease torque of the torsion spring 756. The arbor member 758 may be configured to rotate about axis B from a first arbor member position to a second arbor member position. As described above, the arbor member 758 is coupled to the lever member 764 via a fastener 766 and the lever member 764 is further coupled to the bracket 748 via a protrusion formed on the second end of the bracket 748 sized and/or shaped to engage the first aperture on the lever member 764. Thus, when the rail member 408 rotates about axis 736 from the second rail member position to the first rail member position, the bracket 748 is configured to apply a force to the arbor member 758 via the lever member 764, thereby causing the arbor member 758 to rotate about axis B.

When the rail member 408 is in the second rail member position (shown in FIG. 7C), the arbor member is in the second arbor member position. When the user desires to engage the hooks 744 of the rail member 408 with the catches 746 of the base plate 402, the user may move the rail member 408 from the second rail member position to the first rail member position, thereby causing the bracket 748 to apply a force to the arbor member 758, in turn causing the arbor member 758 to move from the second arbor member position to the first arbor member position. As the arbor member 758 moves from the second arbor member position to the first arbor member position, the arbor member 758 applies a force to the first torsion spring end 757A, thereby twisting the first torsion spring end 757A about axis B, resulting in the increase of stored energy, or torque, in the torsion spring 756. Similarly, the torsion spring 756 is configured to "unwind", wherein the first torsion spring end 757A may apply a force to the arbor member 758, thereby causing the arbor member 758 to rotate about axis B from the first arbor member position to the second arbor member position, which in turn causes the lever member 764 to rotate and apply force to the bracket 748 and rail member 408.

The torsion spring 756 has a first amount of stored force, or torque, when the rail member 408 is in the first rail member position and the torsion spring 756 has a second amount of stored torque when the rail member 408 is in the second rail member position, wherein the first amount of stored torque is greater than the second amount of stored torque. Therefore, as generally understood by one skilled in the art, the torsion spring 756 may be fully loaded when the rail member 408 is in the first rail member position.

As described above, when the rail member 408 is in the first rail member position, the first and second hooks 744 of the rail member 408 are engaged with the first and second catches 746 of the base plate 402. When the rail member 408 is in the first rail member position, the torsion spring 756 is fully loaded and the first amount of stored torque is applied to the rail member 408. When the contact portion 728 of the release trigger 726 makes contact with a portion of the receiver assembly 108 of the firearm 100, the release trigger 726 rotates about axis 738 from the first release trigger position to the second release trigger position, thereby causing the first and second hooks 744 to disengage from the first and second catches 746. When the first and second hooks 744 disengage from the first and second catches 746, the rail member 408 moves to the second rail member position due to the application of the first amount of stored torque from the torsion spring 756.

The release trigger 726 is coupled to first and second hooks 744 via the shaft 808, wherein the shaft 808 is sized and/or shaped to pass through apertures defined on the first and second hooks 744. The shaft 808 may define a recess configured to receive and retain a fastener, such as an e-clip 806. In the illustrated embodiment, the shaft 808 may define multiple recesses configured to receive and retain multiple e-clips 806. The e-clips 806 are configured to retain a portion of the first and second hooks 744 in a secure position and/or in alignment with the first and second catches 746. The e-clips 806 may be further configured to apply a force in a generally longitudinal direction, generally parallel to axis A, from the shaft 808 to the first and second hooks 744, thereby moving the hooks 744 from the engaged position with the catches 746, to a disengaged position. Double-torsion springs 820 may further be provided to create a spring bias force that urges the first and second hooks 744 in a linear direction towards the engaged position. In addition, a return spring 814 may be provided to create a spring bias force that urges the shaft 808 in a linear direction towards the release trigger 726.

When the base plate 402 moves from the first base plate position to the second base plate position, the contact portion 728 of the release trigger 726 may make contact with a portion of the receiver assembly 108 of the firearm 100, thereby causing the release trigger 726 to move from the first release trigger position to the second release trigger position. When in the second release trigger position, the release trigger 726 is configured to apply a force to the shaft 808 in a direction towards the second rail member end 409B and generally parallel to axis A. In turn, the shaft 808 is configured to apply a force to the first and second hooks 744 via the e-clips 806, thereby causing the first and second hooks 744 to disengage from the first and second catches 746. When the first and second hooks 744 disengage from the first and second catches 746, the first amount of stored torque in the torsion spring 756 is applied to the arbor member 758, wherein the torsion spring 758 "unwinds" thereby causing the arbor member 758, and lever member 764, to rotate from the first to the second arbor member position, thereby applying a force against the bracket 748. The bracket 748 forces the rail member 408 to rotate about axis 736 from the first rail member position to the second rail member position.

As described above, first and second links 750, 752 are provided and configured to prevent the rail member 408 from over-rotating past the second rail member position. The first end of the first link 750 is coupled to a third base plate knuckle member 818 formed on the base plate 402, wherein the third base plate knuckle member 818 and the first end of the first link 750 define apertures through which a fastener, such as a pin 816B, may pass. The pin 816B is configured to retain the first end of the first link 750 to the third base plate knuckle member 818. The pin 816 may provide an axis about which the first link 750 may rotate. The first end of the second link 752 is coupled to a third rail member knuckle member 812 formed on the rail member 408, wherein the third rail member knuckle member 812 and the first end of the second link 752 define apertures through which the shaft 808 may pass, wherein the shaft may provide an axis about which the second link 752 may rotate. The second ends of the first and second links 750, 752 are coupled to one another, wherein the second ends may define apertures through which a fastener, such as a pin 816A, may pass. Similarly, the pin 816A may provide an axis about which the first and second links 750, 752 may rotate.

As described above, the rail member 408 may be rotatably coupled to the base plate 402. In the illustrated embodiment, the base plate 402 includes a first base plate knuckle member 796A and a second base plate knuckle member 796B. The rail member 408 includes a first set of rail member knuckle members 798A and a second set of rail member knuckle members 798B sized and/or shaped to correspond to and cooperate with the first and second base plate knuckle members 796A, 796B, respectively. The rail member 408 is coupled to the base plate 402 via the knuckle members, wherein the first set of rail member knuckle members 798A is coupled to the first base plate knuckle member 796A and the second set of rail member knuckle members 798B is coupled to the second base plate knuckle member 796B. The knuckle members 796A, 796B, 798A, 798B may define apertures through which fasteners may pass, such as spring pins 800A, 800B. In the illustrated embodiment, spring pin 800A is configured to secure the first set of rail member knuckle members 798A to retain the first base plate knuckle member 796A and spring pin 800B is configured to retain the second set of rail member knuckle members 798B to the second base plate knuckle member 796B. The spring pins 800A, 80013 may provide the axis 736 about which the rail member 408 may rotate from the first rail member position to the second rail member position.

As described above, a user may desire to open the feed tray cover 114. The feed tray cover release assembly 412 is configured to provide a force against locking latches 224 of the feed tray cover 114, thereby allowing the user to open the feed tray cover 114. In the illustrated embodiment, the feed tray cover release assembly 412 may be coupled to the base plate 402 via the fastener 768. In particular, the rail mount body 514 may define an aperture 772 sized and/or shaped to receive the fastener 768. The rail mount body 514 may further define a bottom surface configured to be attached to the existing mounting rail 120 of the firearm 100. As described above, the feed tray cover release assembly 412 includes first and second rigid members 516A, 516B coupled on either side of the rail mount body 514. In the illustrated embodiment, the rail mount body 514 may include apertures 774 positioned on either side of the rail mount body 514, wherein the apertures 774 are sized and/or shaped to receive fasteners, such as first fastening pins 784A. The first and second rigid members 516A, 516B define a first set of apertures 780 corresponding to and aligned with apertures 774, wherein the first set of apertures 780 are sized and/or shaped to receive the first fastening pins 784A. The first and second rigid members 516A, 516B are rotatably coupled to either side of the rail mount body 514 via the first fastening pins 784A configured to pass through apertures 774 and the first set of apertures 780 and to retain the first and second rigid members 516A, 516B to the rail mount body 514. The first fastening pins 784A may provide axes 742A, 742B about which the first and second rigid members 516A, 516B may rotate about, respectively.

The feed tray cover release assembly 514 further includes a z-bar member 776 positioned between a top surface of the rail mount body 514 and a bottom surface of the base plate 402. The z-bar member 776 may define apertures 778 on either side of the Z-bar member 776 sized and/or shaped to receive fasteners, such as second fastening pins 784B. The first and second rigid members 516A, 516B define second apertures 782 corresponding to and aligned with apertures 778, wherein the second apertures 782 are sized and/or shaped to receive the second fastening pins 784B. The first and second rigid members 516A, 516B are securely coupled to either side of the z-bar member 776 via the second fastening pins 784*b* configured to pass through apertures 778 and the second apertures 782 and to retain the first and second rigid members 516A, 516B to the z-bar member 776.

The second fastening pins 784B provide fixed pivot points about which the first and second rigid members 516A, 516B may pivot. For example, as described above, the release lever 520 may be configured to apply a force to the cammed surface 517 of the first rigid member 516A via the roller member 786 when the release lever 520 rotates to the second release lever position, such that the first and/or second contact portions 518A, 518B move in an inward direction towards to the rail mount body. As the roller member 786 follows the cammed surface 517, the first rigid member 516A is forced in an inward direction and rotates about axis 742A, thereby applying an inward force to left side of the z-bar member 776 at the pivot point created by the second fastening pin 784B. As the z-bar 776 is forced towards the opposing side, the pivot pivot point on the opposite side of the z-bar member 776 applies an outward force against the second aperture 782 of the second rigid member 516B. In turn, the second rigid member 516B is configured to pivot about the pivot point, thereby causing the second rigid member 516B to rotate about axis 742B and the contact portion 518B of the second rigid member 516B to move in an inward direction toward the rail mount body 514. The roller member 786 may define an aperture through which a pin 788 may pass and fix the roller member 786 to the release lever 520. In addition, the release lever 520 may be coupled to the shaft 515 via a washer 790 and a fastener, such as a snap ring 792.

Figure 1:
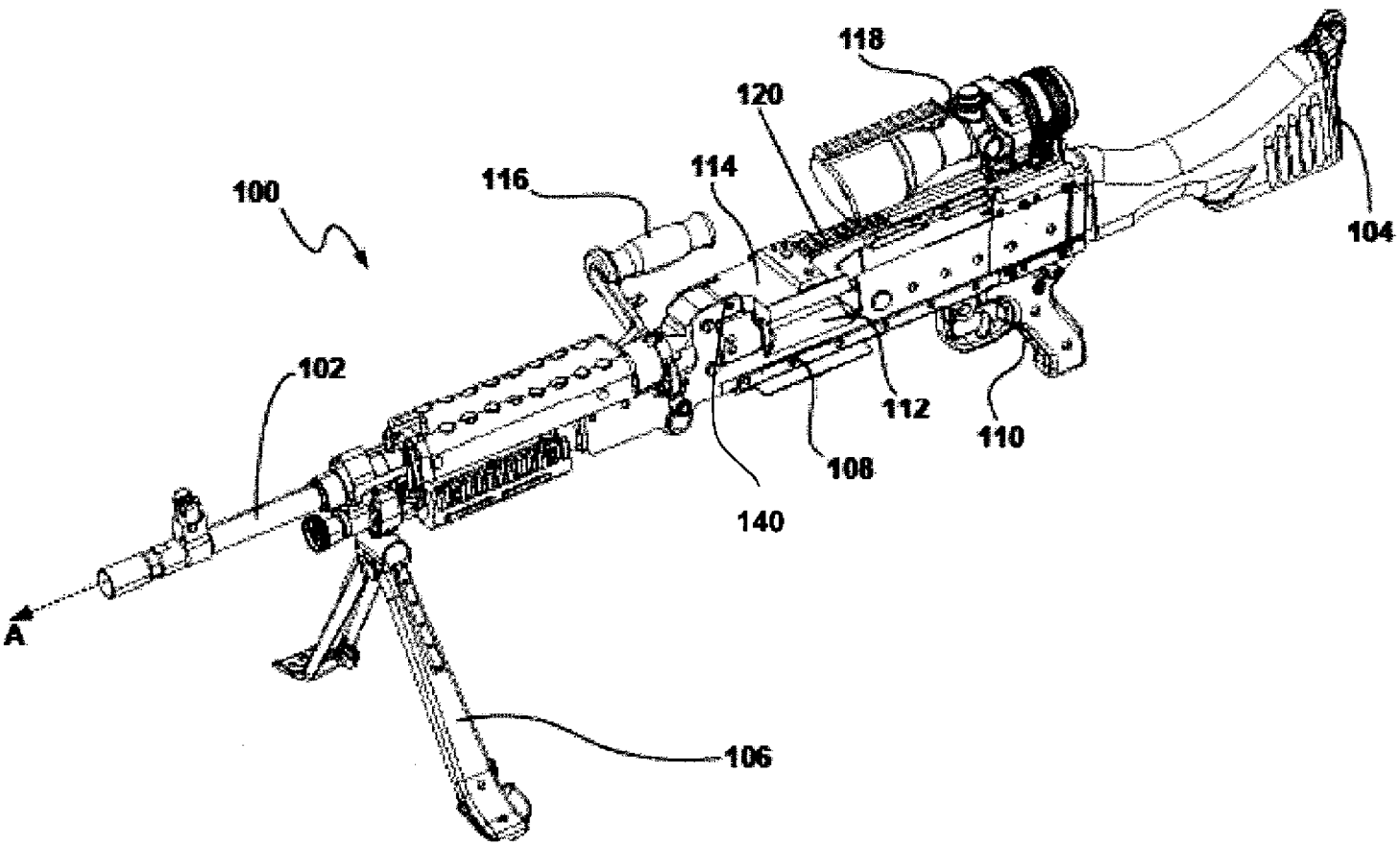
FIG. 1 is an isometric view of a firearm having a standard rail interface system and rear scope attached thereto with a feed tray cover of the firearm in a closed position.
Figure 8:
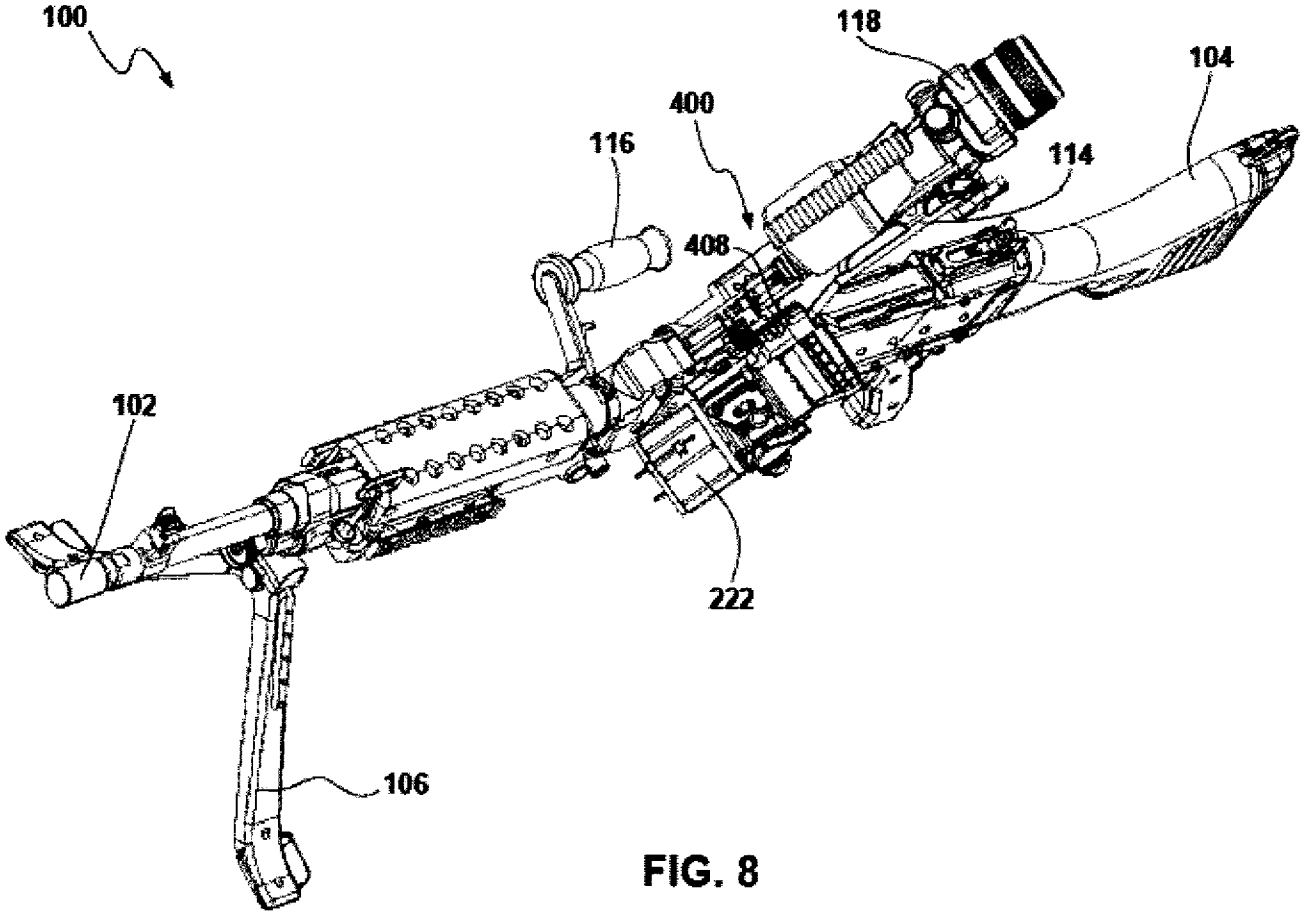
FIG. 8 is an isometric view of the rail extension device of FIG. 7A mounted to the standard rail interface system of the firearm of FIG. 1 showing front and rear scopes attached to the rail extension device with the feed tray cover in the opened position and the rail member in the second rail member position.

FIG. 8 is an isometric view of the rail extension device of FIG. 7A mounted to the mounting rail of the firearm of FIG. 1 showing front and rear scopes attached to the rail extension device with the feed tray cover in the opened position and the rail member in a second rail member position. In the illustrated embodiment, the rail member 408, coupled with a night vision scope 222, is in the second rail member position, thereby allowing the feed tray cover 114 to fully rotate to an open position. In the illustrated embodiment the night vision scope 222 does not make any impact with any portion of the receiver assembly 108. In this instance, the user is not required to remove the night vision scope 222 in order for the feed tray cover 114 to fully rotate to the open position.

Figure 9:
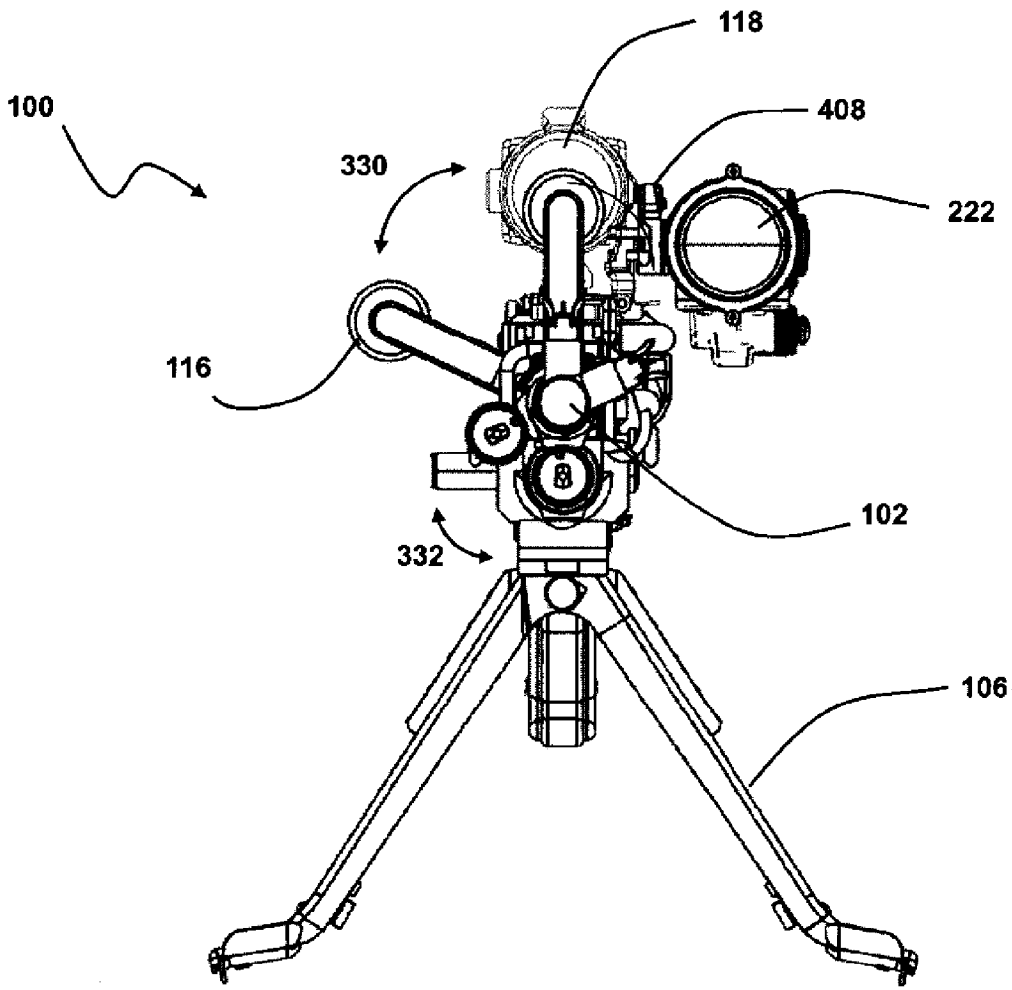
FIG. 9 is a front (distal or muzzle facing) view of the rail extension device of FIG. 7A mounted to the standard rail interface system of the firearm of FIG. 1 showing front and rear scopes attached to the rail extension device with the handle and barrel of the firearm alternating between a first position and a second position during a barrel exchange.

FIG. 9 is a front view of the rail extension device of FIG. 7A mounted to the mounting rail of the firearm of FIG. 1 showing front and rear scopes attached to the rail extension device with the handle and barrel of the firearm alternating between a first position and a second position during a barrel exchange. In the illustrated embodiment, the night vision scope 222 is attached to rail member 408, wherein the rail member is in the second rail member position, thereby allowing the handle 116 and barrel 102 to fully move from the first to second positions, thus allowing the barrel to be rapidly changed without requiring the user to remove the additional night vision scope 222.

Figure 10:
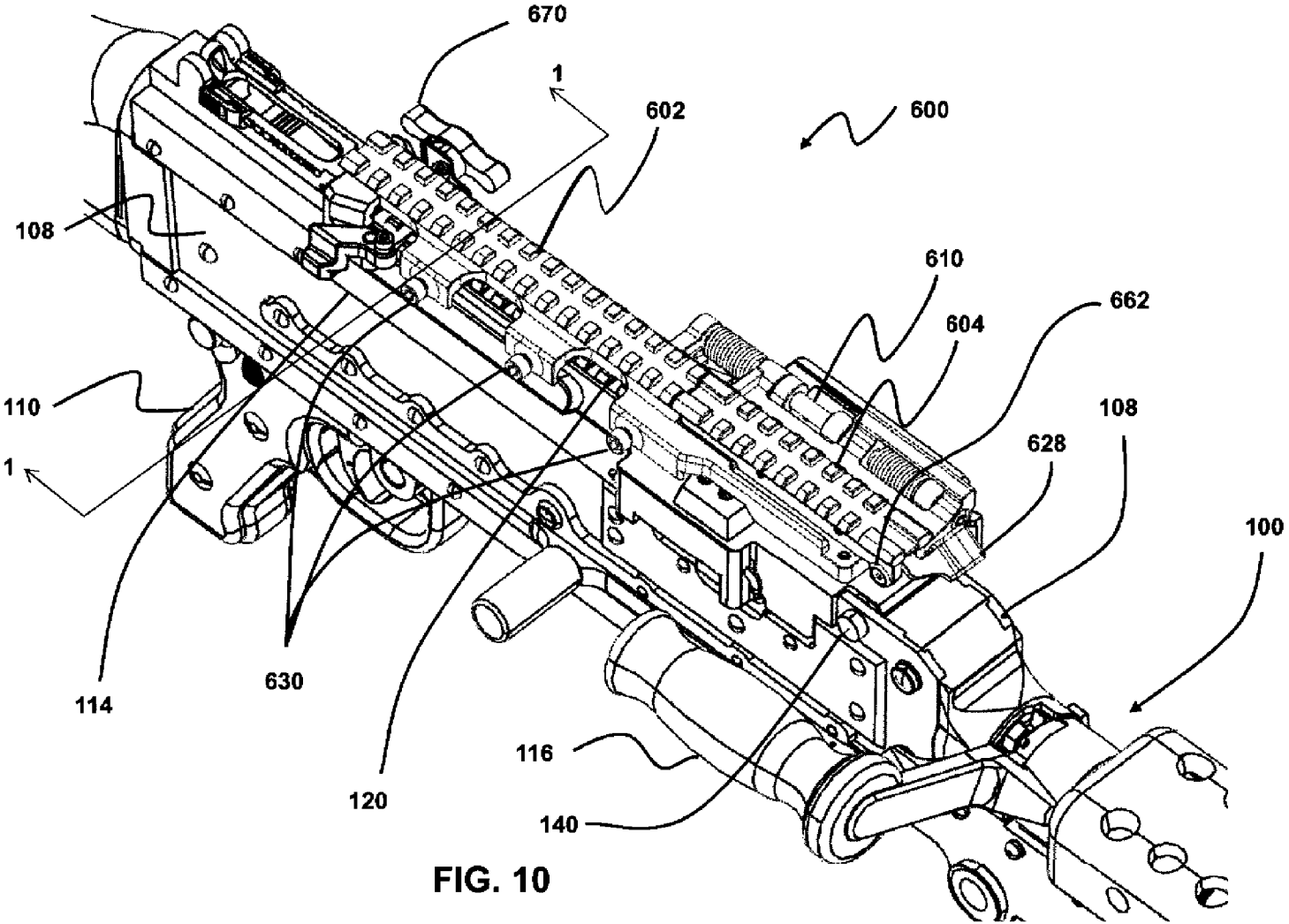
FIG. 10 is an isometric view of one embodiment of another rail extension device mounted on the standard rail interface system of the firearm of FIG. 1 with the feed tray cover in the closed position, consistent with the present disclosure.
Figure 11:
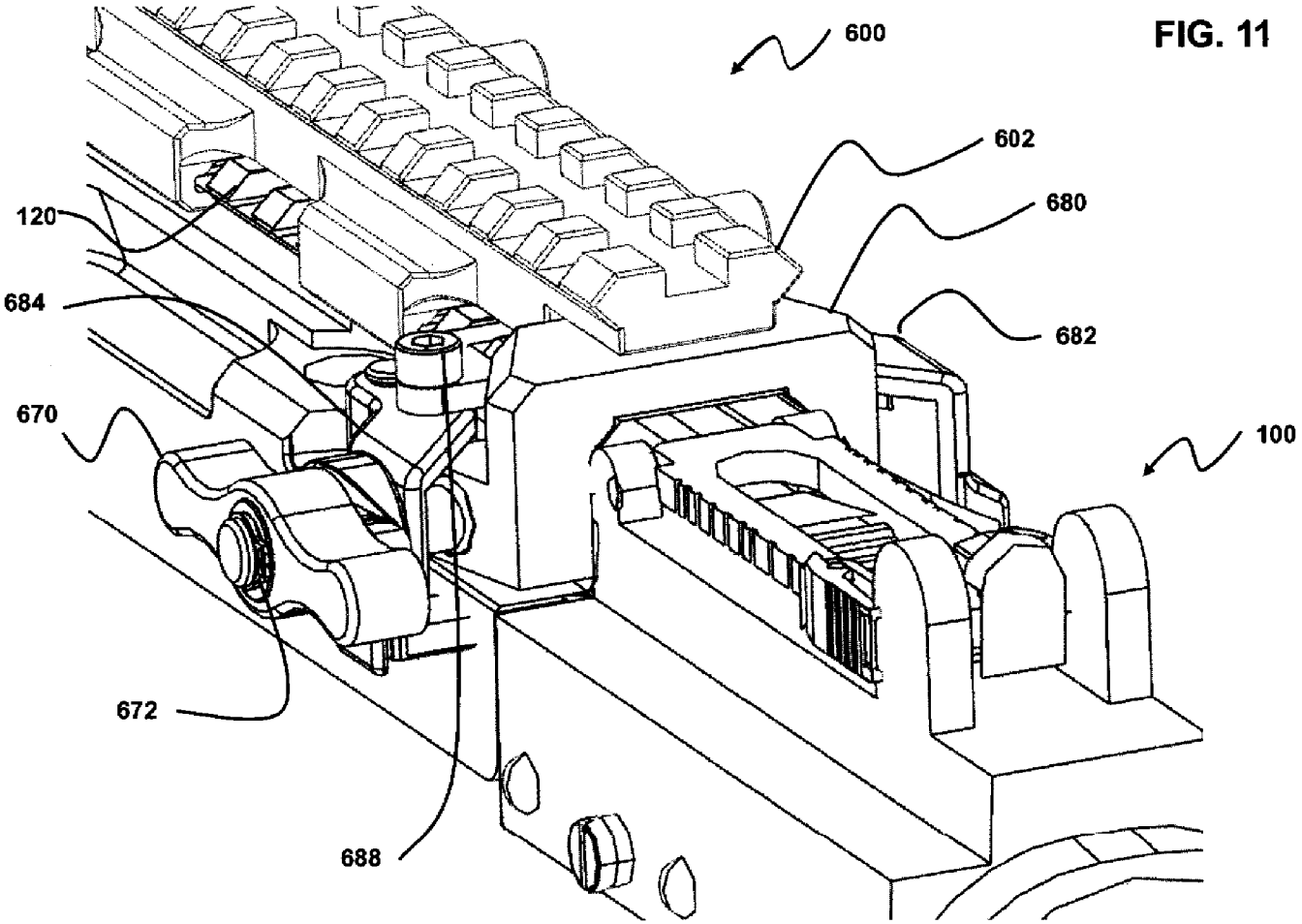
FIG. 11 is an alternate isometric view showing a feed tray cover release assembly of the rail extension device of FIG. 10.
Figure 12:
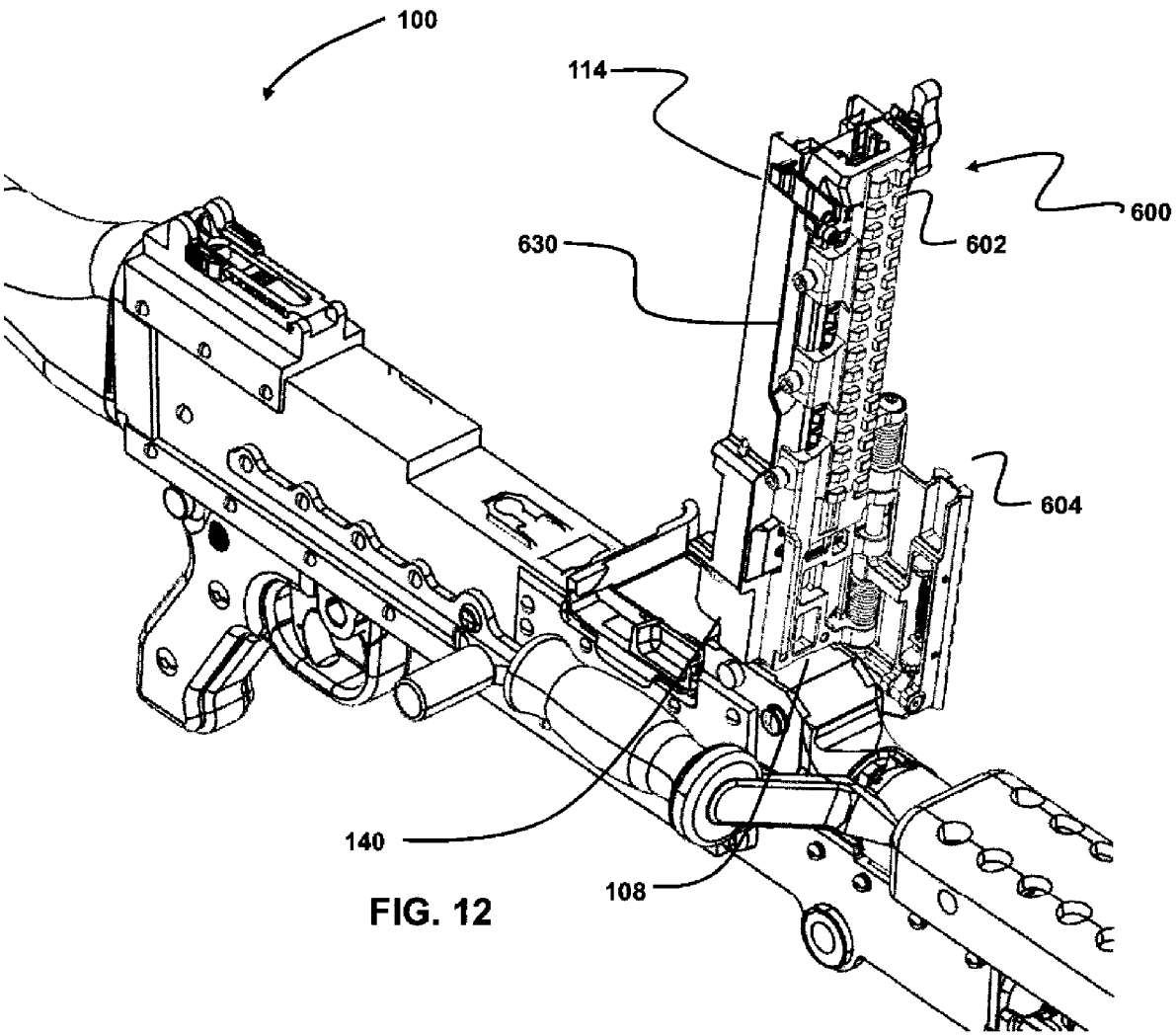
FIG. 12 is an isometric view of the rail extension device of FIG. 10 mounted on the standard rail interface system of the firearm of FIG. 1 with the feed tray cover in the open position
Figure 13:
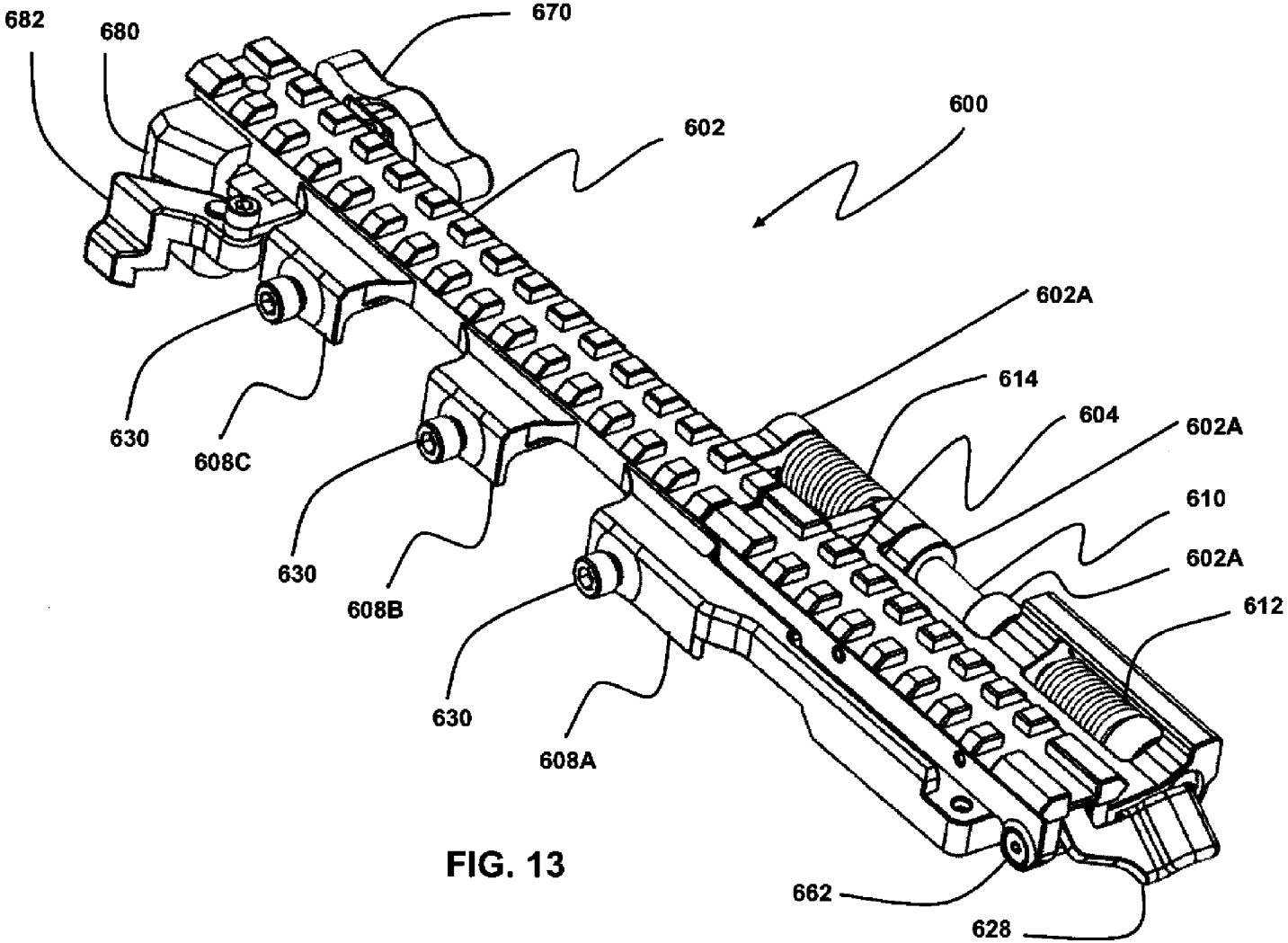
FIG. 13 is an isometric view of the rail extension device of FIG. 10 with the rail member in a first rail member position.
Figure 14:
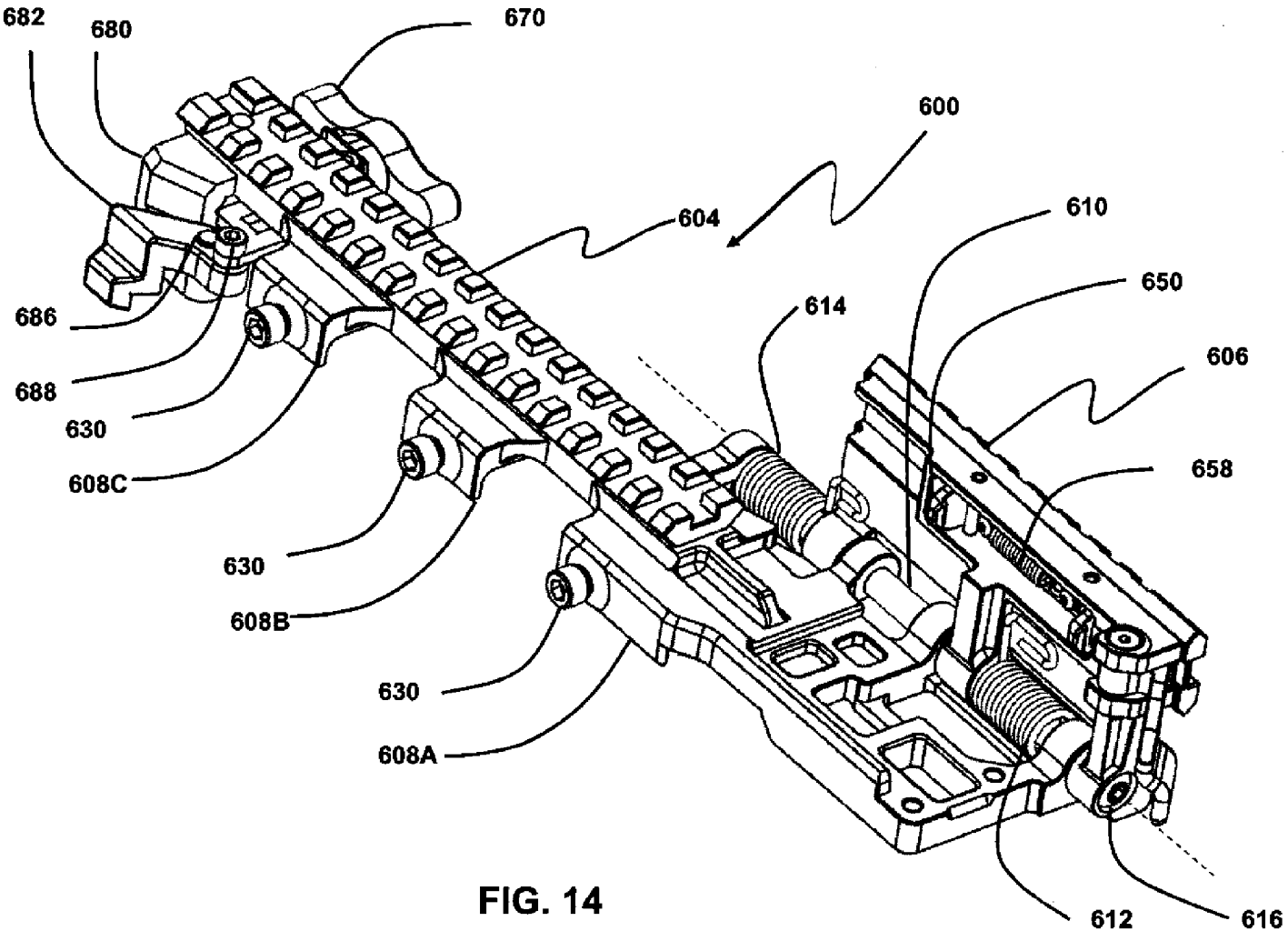
FIG. 14 is an isometric view of the rail extension device of FIG. 10 with the rail member in a second rail member position.
Figure 15:
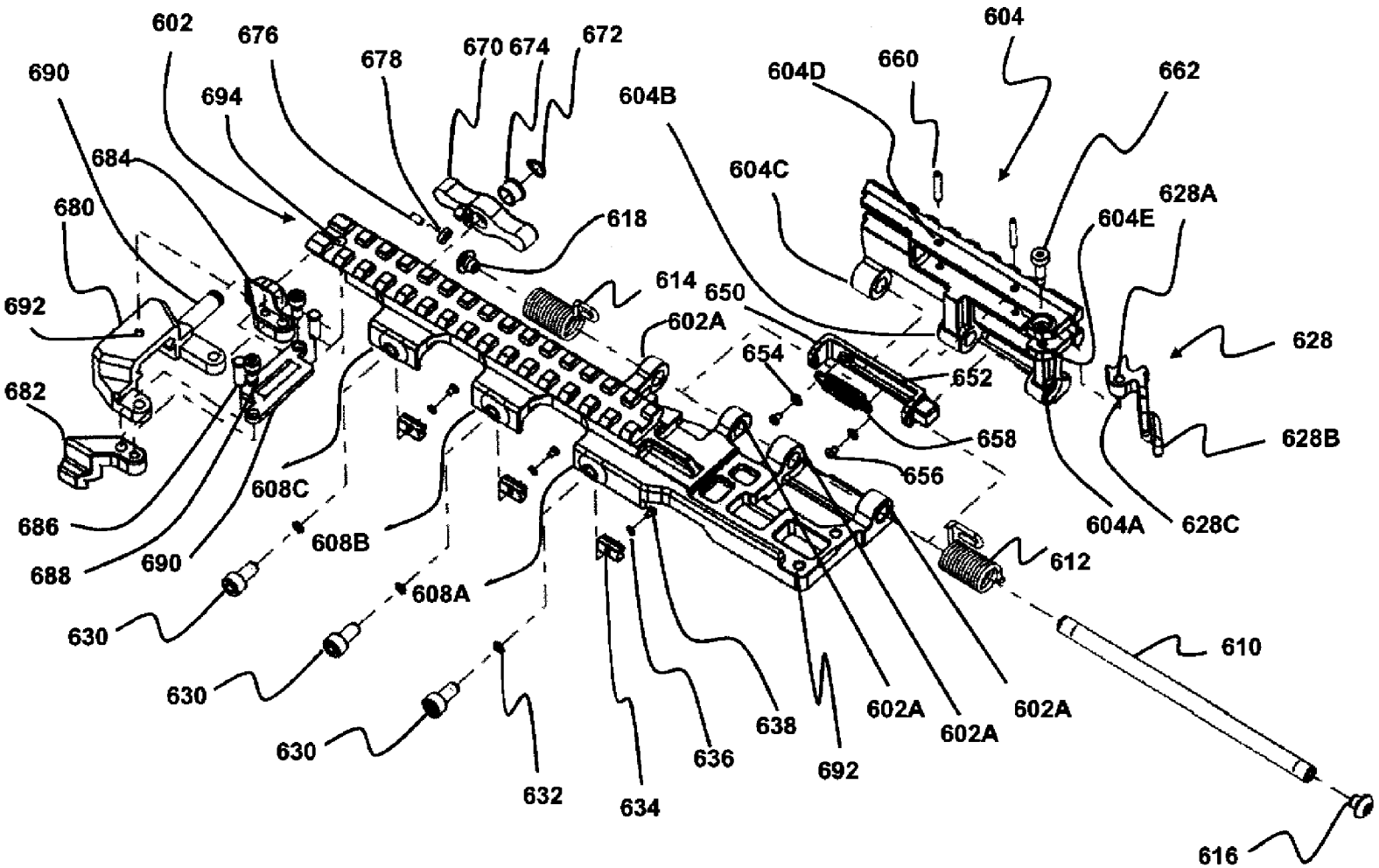
FIG. 15 is an exploded view of the rail extension device of FIG. 10 with the rail member in the second rail member position.
Figure 16:
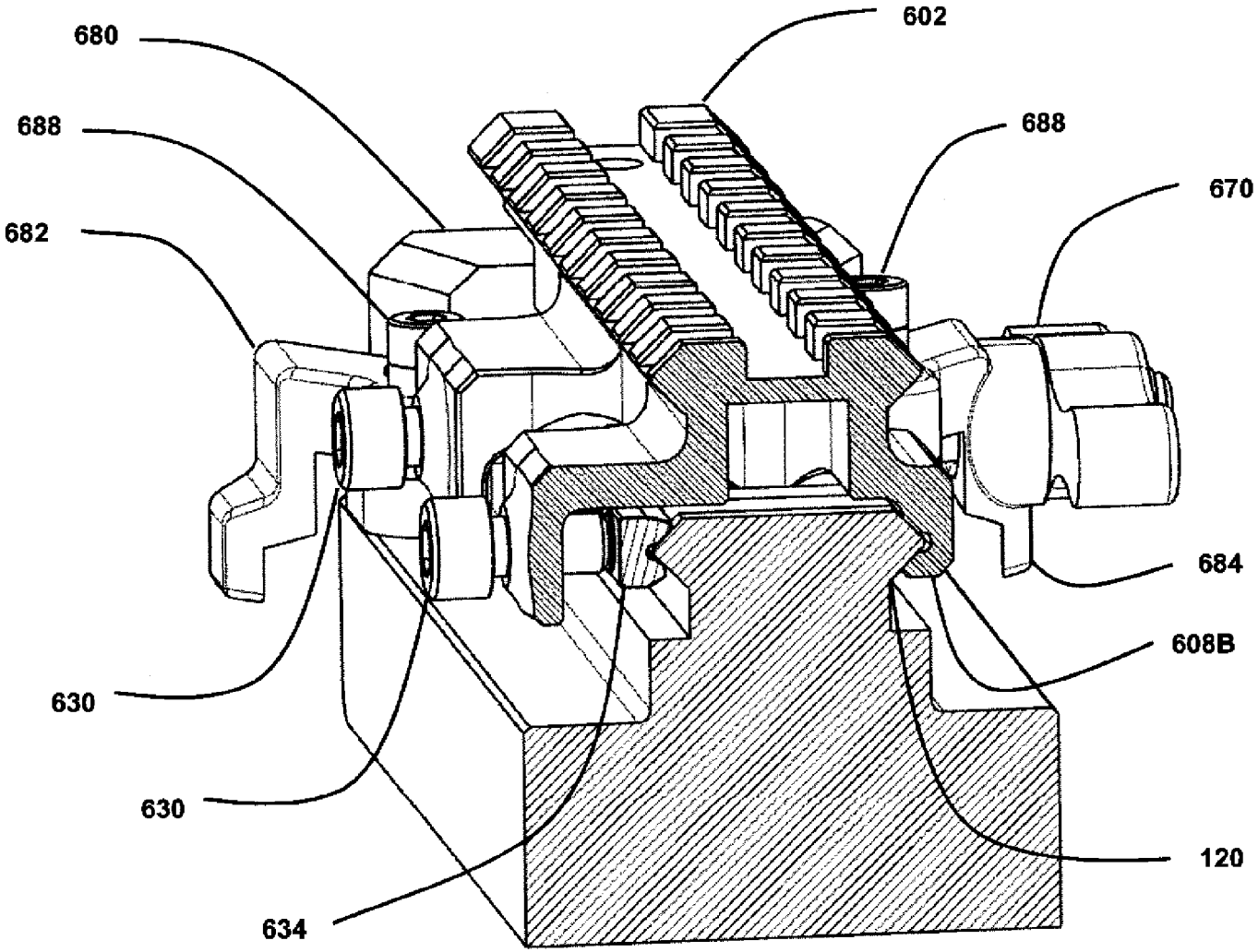
FIG. 16 is a section view taken through line 1-1 in FIG. 10.
Figure 17:
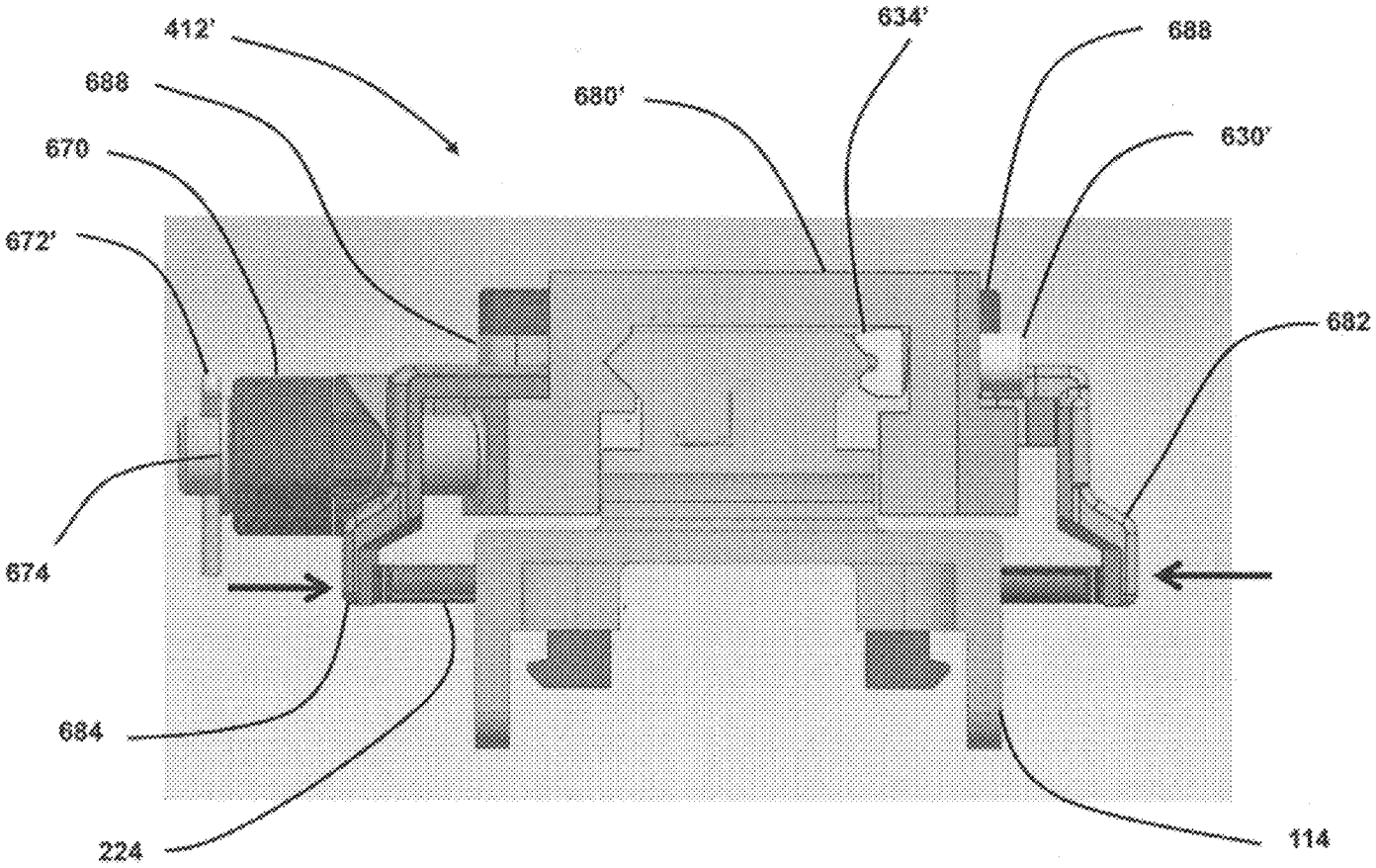
FIG. 17 is an end view of the rail extension device of FIG. 10.

FIG. 10 is an isometric view of one embodiment of another rail extension device 600 mounted on the standard rail interface system of the firearm of FIG. 1 with the feed tray cover 114 in the closed position, consistent with the present disclosure. FIG. 11 is an alternate isometric view showing a feed tray cover release assembly of the rail extension device of FIG. 10; FIG. 12 is an isometric view of the rail extension device of FIG. 10 mounted on the standard rail interface system of the firearm of FIG. 1 with the feed tray cover in the opened position; FIG. 13 is an isometric view of the rail extension device of FIG. 10 with the rail member in a first rail member position; FIG. 14 is an isometric view of the rail extension device of FIG. 10 with the rail member in a second rail member position; FIG. 15 is an exploded view of the rail extension device of FIG. 10 with the rail member in the second rail member position; FIG. 16 is a section view taken through line 1-1 in FIG. 10; and FIG. 17 is an end view of the rail extension device of FIG. 10.

The rail extension device 600 may be secured to the mounting rail 120 of the firearm 100, e.g. an M240 machine gun, with one or more fasteners 630. The rail extension device 600 may have a first rail member 602 and a second rail member 604. The second rail member 604 may rotate about a pin 610, which may have an axis generally parallel with the longitudinal axis A of the firearm 100. The second rail member 604 may be movable from a first rail member position shown in FIG. 13 to a second rail member position shown in FIG. 14. The fasteners 630 may extend through washers 632, brackets 608A, 608B, and 608C in the first rail member 602. The fasteners 630 may have a clamp 634 coupled to one end with a washers 636 and another fastener 638. The clamp may have a profile that cooperates with and comes into contact with the mounting rail 120. Alternatively, the fasteners may incorporate an adjustable over-center mechanism. As shown in FIG. 16, one side of the underside of first rail member 602 may also be contoured to cooperate with the profile of the mounting rail 120. When the fasteners 630 are tightened, the first rail member 602 is coupled to the mounting rail 120. The underside of the first rail member 602 may have one or more protuberance that cooperate with slot in the mounting rail 120 to resist longitudinal motion. The feed tray cover 114 with the first rail member 602 coupled thereto may rotate about an existing pin 140 from a closed position shown in FIG. 10 to an open position shown in FIG. 12.

As described above with reference to FIG. 1, a user may desire to open the feed tray cover 114. The operator may rotate a feed tray cover release actuator 670 which may be configured to force first paddle 684 and second paddle 682 inward against locking latches 224 (See FIG. 5) of the feed tray cover 114, thereby allowing the user to open the feed tray cover 114. A bracket 680, pins 686, and fasteners 688 may be configured to translate the inward rotation of first paddle 684 into an inward rotation of the second paddle 682. The feed tray cover release actuator 670 may rotate about a member 690 extending from the bracket 680 and may be secured with sleeve 674 and a clip 672. A protrusion, for example a wheel rotatable about an axis generally parallel with the longitudinal axis A of the weapon 100, may translate the rotation of the feed tray cover release actuator 670 into linear movement of the first paddle 684 along the member 690. The bracket 680 may have an opening sized to cooperate with an upstanding portion of the mounting rail 120 to resist longitudinal movement.

In the embodiment shown in FIG. 15, the underside of the bracket 680 may be contoured to cooperate with the profile of the mounting rail 120 and the bracket 680 may be secured to the first rail member 602 with a fastener extending through opening 692 in the bracket 680 and an opening 694 in the first rail member 602. In another embodiment shown in FIG. 17, one of the undersides of a bracket 680' is contoured to cooperate with the profile of the mounting rail 120 and a clamp 634' having a profile that cooperates with and comes into contact with the mounting rail 120 may be secured in place with a fastener 630'.

The rail extension device 600 may include a release trigger 628 rotatably coupled to the second rail member 604 via a fastener 662. The release trigger 628 may be actuated when the feed tray cover 114 is rotated from the closed position towards the open position. The fastener 662, for example a pin or screw, inserted through an opening 604E in the second rail member 604 and an opening 628A in the release trigger 628 and then into a boss 604A may rotational couple the release trigger 628 to the second rail member 604. Rotational movement of the release trigger 628 may be translated into linear movement of a latch 652 that may cooperate with features in the first rail member 602 to secure the second rail member 604 in a "locked" position. A spring 658 or other biasing member may be used to bias the latch towards an engaged position. The spring 658 may be coupled to the latch 652 with one or more fasteners 656 and washers 654. Pins 660 may couple the latch 652 to the second rail member 604 and allow the latch to travel in a direction parallel with the longitudinal axis A of the weapon 100.

When the release trigger 628 is actuated, one or more springs 612, 614 or other biasing member(s), may cause the second rail member 604 to rotate about a pivot pin 610 from its first position shown in FIG. 13 to its second position shown in FIG. 14. The pin 610 may extend generally parallel with the longitudinal axis A of the weapon 100 through bosses 602A on the first rail member 602 and bosses 604A, 604B, and 604C on the second rail member 604. The linear travel of the pin 610 may restricted by fasteners 616, 618 inserted in opposing ends of the pin 610.

When an operator wishes to recommence firing of the weapon 100 after reloading ammunition, he or she simply rotates the feed tray cover 114 about the pin 140 and then rotates the second rail member 604 about pin 610. When the feed tray cover 114 comes into contact with the feed tray 112 the latches 224 will automatically reengage with the feed tray 112 and when the second rail member 604 comes into contact with the first rail member 602, the latch 652 will reengage with the first rail member 602.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A retrofit kit for a belt fed machine gun, comprising a first rail member configured to be coupled to a feed tray cover of the machine gun; and a second rail member coupled to the first rail member, the second rail member rotatable about the first rail member from a first position to a second position about an axis, the feed tray cover movable from a closed position to an open position, movement of the feed tray cover from the closed position to the open position causing a release trigger to be actuated thereby causing the second rail member to rotate from the first position to the second position, the axis being parallel with a barrel of the machine gun when the feed tray cover is in the closed position.

2. The retro kit for a belt fed machine gun of claim 1, further comprising a spring configured to bias the second rail member towards the second position.

3. The retro kit for a belt fed machine gun of claim 1, further comprising a rear latch assembly for releasing the feed tray cover from the closed position, the latch assembly having a knob located to one side of the feed tray cover, rotation of the knob causing a first paddle and a second paddle to move inward against one or more latches used to secure the feed tray cover in the first position.

* * * * *